US011357379B2

(12) United States Patent
Stuchlik et al.

(10) Patent No.: US 11,357,379 B2
(45) Date of Patent: Jun. 14, 2022

(54) FLUID MANIFOLDS FOR FLOOR CLEANING MACHINE

(71) Applicant: Nilfisk A/S, Brøndby (DK)

(72) Inventors: William Randall Stuchlik, Rogers, AR (US); David Wood, Brooklyn Park, MN (US)

(73) Assignee: Nilfisk A/S, Brøndby (DK)

( * ) Notice: Subject to any disclaimer, the term of this patent is extended or adjusted under 35 U.S.C. 154(b) by 507 days.

(21) Appl. No.: 15/975,623

(22) Filed: May 9, 2018

(65) Prior Publication Data

US 2019/0343363 A1 Nov. 14, 2019

(51) Int. Cl.
*A47L 11/282* (2006.01)
*A47L 11/40* (2006.01)

(52) U.S. Cl.
CPC ..... *A47L 11/4083* (2013.01); *A47L 11/282* (2013.01)

(58) Field of Classification Search
CPC ..... B08B 3/024; B08B 1/04; B05B 1/323; B05B 7/12
See application file for complete search history.

(56) References Cited

U.S. PATENT DOCUMENTS 4,173,056 A 11/1979 Geyer
4,353,145 A * 10/1982 Woodford ..... A47L 11/34 15/320
4,854,005 A 8/1989 Wiese
4,956,891 A * 9/1990 Wulff ..... A47L 11/302 15/320
5,587,021 A 12/1996 Hoersch et al.
RE36,565 E 2/2000 Burgoon et al.
(Continued)

FOREIGN PATENT DOCUMENTS

GB 2490804 11/2012
WO WO-2004017805 A1 * 3/2004 ..... A47L 11/4077
(Continued)

OTHER PUBLICATIONS

"Clark® Focusll™ Operator's Manual", Models: 9087202020-9087203020, (2011), 138 pgs.
(Continued)

*Primary Examiner* — Joseph L. Perrin
*Assistant Examiner* — Irina Graf
(74) *Attorney, Agent, or Firm* — Schwegman Lundberg & Woessner, P.A.

(57) ABSTRACT

A random orbit scrubber comprises a main body having a front end and a rear end, a squeegee assembly coupled to the rear end of the main body, and a cleaning head assembly coupled to the front end of the main body. The cleaning head assembly can include a cleaning element structured for contact with a floor surface. The cleaning head assembly can further include a motor that is operable to impart rotational and orbital movement on the cleaning element. The cleaning head assembly can also include one or more arcuate cleaning fluid manifolds each having a plurality of dispensing points to distribute cleaning fluid in one or more locations on top of and in front of the cleaning element. The arcuate cleaning fluid manifolds can include variable flow nozzles and can be mounted to a carriage that rotates about the cleaning head assembly.

32 Claims, 26 Drawing Sheets

(56) References Cited

U.S. PATENT DOCUMENTS 6,389,329 B1* 5/2002 Colens ..... A47L 9/2852 700/262
6,705,332 B2 3/2004 Field et al.
6,964,081 B1 11/2005 Clement et al.
7,185,397 B2 3/2007 Stuchlik et al.
7,302,733 B2 12/2007 Rau et al.
8,528,142 B1 9/2013 Pedlar et al.
8,551,262 B2 10/2013 Eklund
8,839,479 B2 9/2014 Hruby
8,984,696 B2 3/2015 Stuchlik et al.
9,119,518 B2* 9/2015 Hruby ..... A47L 11/4083
9,357,895 B2 6/2016 Leifheit et al.
9,370,289 B2 6/2016 Kauffman
9,649,003 B2 5/2017 Stuchlik et al.
9,924,844 B1 3/2018 Person et al.
2003/0019069 A1* 1/2003 Field ..... A47L 11/03 15/320
2003/0159230 A1* 8/2003 Oh ..... A61L 2/035 15/320
2004/0256483 A1* 12/2004 Guest ..... A47L 11/4088 239/146
2005/0160553 A1* 7/2005 Gregory ..... A47L 7/0009 15/320
2006/0179599 A1* 8/2006 Miner ..... A47L 11/4044 15/320
2006/0254008 A1* 11/2006 Hahn ..... A47L 11/4091 15/50.3
2008/0078041 A1* 4/2008 Mitchel ..... A47L 11/4069 15/50.3
2008/0201896 A1* 8/2008 Lehman ..... A47L 11/03 15/320
2008/0271757 A1 11/2008 Mitchell
2012/0118319 A1 5/2012 Stuchlik et al.
2012/0151696 A1* 6/2012 Hamblin ..... A47L 11/4066 15/4
2014/0259514 A1* 9/2014 Vail ..... A47L 11/29 15/322
2016/0051116 A1* 2/2016 Charlton ..... B05B 1/3006 239/1
2016/0066760 A1* 3/2016 Citsay ..... C25B 15/08 134/6
2017/0215676 A1* 8/2017 Moser ..... A47L 11/408
2019/0208977 A1* 7/2019 Killi ..... A47L 11/4083

FOREIGN PATENT DOCUMENTS

WO 2007117351 10/2007
WO 2012054506 4/2012

OTHER PUBLICATIONS

"European Application Serial No. 19172984.7, European Search Report dated Sep. 9, 2019", 5 pgs.

* cited by examiner

FLUID MANIFOLDS FOR FLOOR CLEANING MACHINE

BACKGROUND OF THE INVENTION

The present application relates generally to a cleaning apparatus. More specifically, the present application relates to a floor cleaning machine having a cleaning fluid manifold.

Floor cleaning machines can be configured as push machines, walk-behind machines or ride-along machines. The effectiveness of floor cleaning machines can be improved by increasing or maintaining contact with the floor, improving the scrubbing action or motion, and effective use of cleaning fluid.

Rotary disc type scrubbers have been used for decades to clean hard floor surfaces such as tile, linoleum, and concrete. These hard floor surfaces are often uneven, which can present challenges to the scrubber in maintaining contact with the floor and can result in a floor that is not cleaned in a uniform fashion. One approach to cleaning uneven floors is to provide a flexible coupling between the cleaning element or medium and the cleaning head assembly such as a gimbaled pad holder, or scrub brush coupler. The gimbaled design allows some degree of freedom to the cleaning element, allowing it to tilt in response to the uneven floor.

The scrubbing action of these machines can be improved by use of orbital scrubbing. Random orbit disc scrubbers are described in detail in U.S. Pat. Nos. 8,984,696 and 9,649,003 to Stuchlik et al., which are assigned to Nilfisk-Advance, Inc.

An additional challenge for conventional floor cleaning machines is excess water consumption. In the past, it was a widely held belief that the cleaning efficacy was positively correlated to the amount of cleaning fluid applied to the floor. This notion has fallen from favor as the floor cleaning industry has become more ecologically conscious. Various approaches have been developed by floor equipment companies to reduce the amount of water applied to the floor by improving cleaning fluid distribution. One approach to controlling cleaning fluid distribution is through the use of a cleaning fluid manifold. Various cleaning fluid manifolds for floor cleaning machines are disclosed in U.S. Pat. No. 7,302,733 to Rau et al., U.S. Pat. No. 9,370,289 to Kauffman, and U.S. Pub. No. 2008/0271757 to Mitchell.

Notwithstanding the aforementioned systems, there is still a need for an improved floor cleaning machine that will conserve water without compromising cleaning quality.

SUMMARY OF THE INVENTION

The inventors of the present application have recognized a need for improving the performance of cleaning fluid manifolds, particularly those used with random orbit scrubbers. Many previous manifold designs are shaped and located with little or no regard to the cleaning element shape, the cleaning action and the cleaning machine travel path. For example, previous cleaning fluid manifolds are straight and simply dump fluid in front of the cleaning element. These cleaning manifold designs often result in cleaning fluid being deposited only partially within the cleaning fluid path. With these designs, cleaning fluid deposited outside of the cleaning element path is wasted, and cleaning fluid deposited within the cleaning fluid path can be inadequately distributed to facilitate effective cleaning. Furthermore, when used with orbital scrubbers, previous cleaning fluid manifolds do not distribute cleaning fluid with sufficient floor coverage to account for both rotating and orbiting scrubbing action.

The present inventors have recognized a solution to these and other problems by recognizing that excess cleaning fluid consumption can be addressed by more strategic placement of the cleaning fluid so that an appropriate amount of cleaning fluid is applied close to where it is needed. The cleaning fluid manifolds of the present application can address the aforementioned needs by being located in front of or above a cleaning element, such as a pad or brush, to, among other things, evenly distribute cleaning fluid to the cleaning element. In various examples, the cleaning fluid manifold can conform to the shape of the cleaning element, such as by being arcuate for round scrubbing pads and brushes. Additionally, the cleaning fluid manifold can be mounted separate from the cleaning element driver block to permit rotating and orbital cleaning action. Also, the cleaning fluid manifold can be rotatably mounted to a cleaning head assembly to remain positioned within the cleaning element path during turning operations of the cleaning machine. In examples, a floor cleaning machine can include one or more manifolds to dispense cleaning fluid in different locations or at different pressures or volumes. Furthermore, the cleaning fluid manifolds can include spray nozzles that permit variable flows of cleaning fluid.

The manifolds disclosed in the present application can locate a desired amount cleaning fluid into the cleaning element to eliminate over-application of cleaning fluid, which reduces waste. Additionally, manifolds disclosed herein can reduce splashing and spraying of cleaning fluid by the cleaning element that can result from over-application of cleaning fluid, thereby eliminating or reducing the need for splash skirts and splash guards.

In an example, a floor scrubber machine can comprise a main body having a front end and a rear end, a cleaning fluid tank carried by the main body, a cleaning head assembly connected to the main body, and an arcuate cleaning fluid manifold. The cleaning head assembly can comprise a cleaning element driver, a motor configured to impart rotational movement through a shaft to the cleaning element driver, and a cleaning element coupled to the cleaning element driver and structured for contact with a floor surface. The arcuate cleaning fluid manifold can be fluidly coupled to the cleaning fluid tank. The arcuate cleaning fluid manifold can be mounted to the floor scrubber machine forward of the shaft.

In another example, a scrubber head assembly for a floor cleaning machine can comprise a mounting plate having an opening, a motor-driven shaft extending through the opening, a driver coupled to the motor-driven shaft, and three or more cleaning fluid apertures disposed at different circumferential positions relative to the motor-driven shaft. The driver can be configured to couple to a cleaning element for contacting a surface of a floor. The three or more cleaning fluid apertures can be configured to dispense cleaning fluid on, under or in front of the driver.

In yet another example, a random orbit scrubber can comprise a main body having a front end and a rear end, a cleaning fluid tank carried by the main body, a cleaning head assembly connected to the main body, and an arcuate cleaning fluid manifold fluidly coupled to the cleaning fluid tank. The cleaning head assembly can comprise a cleaning element driver a cleaning element coupled to the cleaning element driver and structured for contact with a floor surface and a motor operable to impart rotational and orbital movement on the cleaning element. The cleaning fluid manifold can be mounted to the random orbit scrubber forward of the motor.

DETAILED DESCRIPTION OF THE INVENTION

Figure 1:
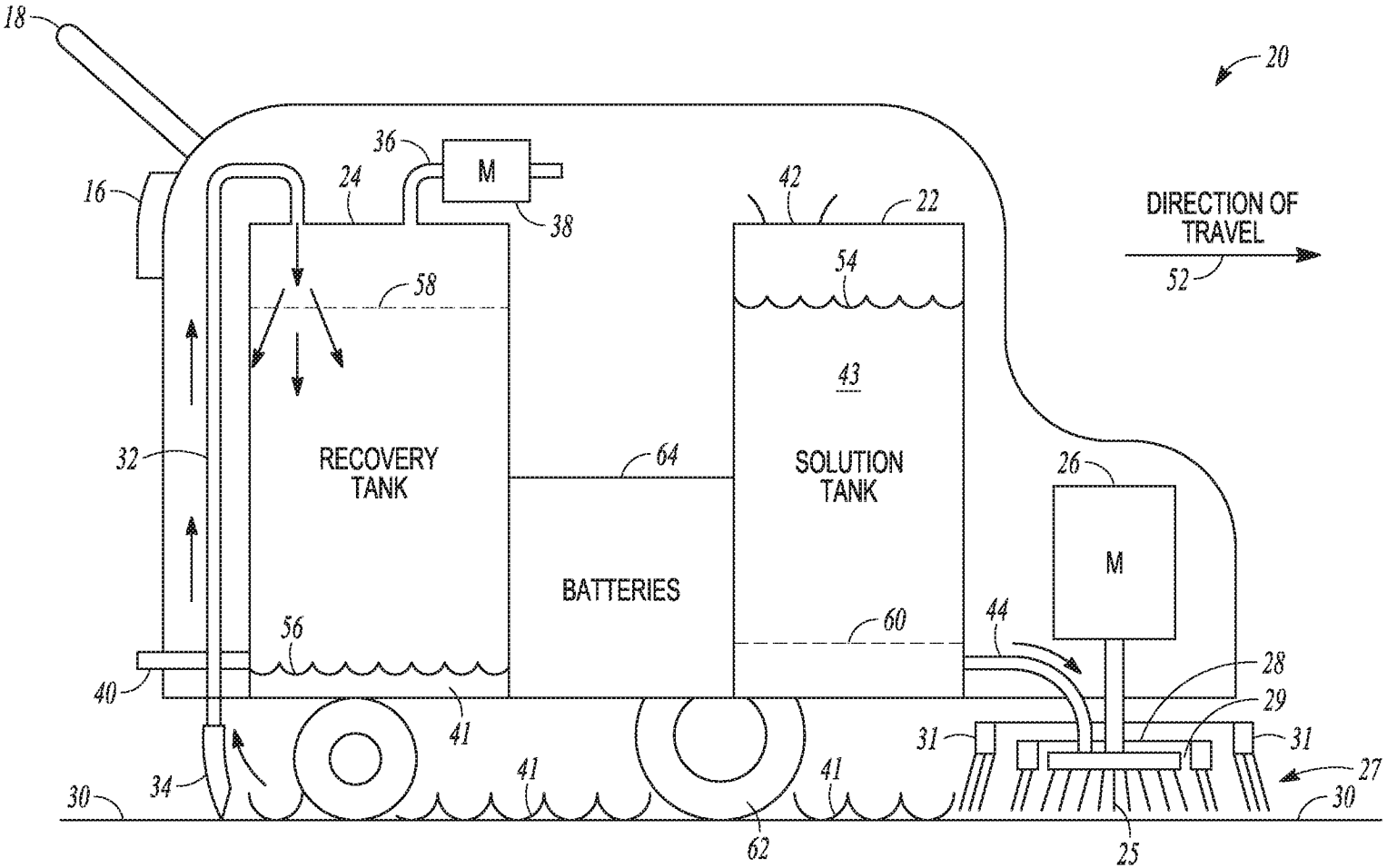
Fig. 1 (Prior Art)
FIG. 1 is a schematic view of a prior art rotary motion scrubber.

FIG. 1 is a schematic diagram of a prior art rotary motion type scrubber generally identified by the numeral 20. Particularly, the scrubber 20 uses a cleaning head assembly 27 having a disc shaped cleaning brush 28 that rotates about the shaft of a brush motor 26. Instead of a brush, the cleaning head assembly 27 can utilize a cleaning pad as will be appreciated by those skilled in the art. Scrubbers of this type are generally designed to clean hard floor surfaces such as tile, linoleum, and concrete. These rotary motion scrubbers are typically used in medical facilities, office buildings, educational facilities, restaurants, convenience stores, and grocery stores.

The operator, not shown, walks behind the scrubber 20 and grips the handle 18 to control the direction of travel as indicated by the arrow at the front of the scrubber. A control panel 16 can be positioned at the rear of the scrubber and has various control devices and systems well known to those skilled in the art. The control devices and systems are in electrical connection with the various operating components of the scrubber.

In various examples, there can be an on/off switch and a cleaning head assembly position control device. The cleaning head assembly 27 can include a raised position where the brush 28 is not in contact with the floor surface and a lowered position where the brush 28 is in contact with the floor surface. When the on/off switch is "on" and the cleaning head assembly 27 is placed in the lowered position, a touch down switch can activate the brush motor 26 to scrub the floor.

There can also be a control device to vary the amount of downward load on the cleaning head assembly 27. Some scrubbers have an adjustable actuator that can vary the amount of downward load on the cleaning head assembly 27. Alternatively, scrubbers can have weights on the cleaning head assembly 27 that exert a constant load. For those scrubbers with adjustable load control devices, a heavy load can be used for very dirty floors. Lightly soiled floors require minimum load.

Additional controls can include, but are not limited to, an adjustable flow control device for controllably dispensing the cleaning fluid and a squeegee position control device for raising and lowering a squeegee 34.

The rotary motion scrubber 20 can have a solution tank 22 and a recovery tank 24. As illustrated in FIG. 1, the brush motor 26 can drive a disc shaped brush 28 which has bristles 25 that engage the hard surface floor 30. A conduit 32 can connect the squeegee 34 to the recovery tank 24. A conduit 36 can connect the recovery tank 24 with the vacuum motor 38 which can be vented to atmosphere. A drain 40 can be used to drain the dirty fluid 41 from the recovery tank 24.

Concentrated cleaning fluid 43 can be poured into the solution tank 22 through the solution tank inlet 42. The cleaning fluid 43 can be a liquid and typically includes a mixture of tap water and a cleaning agent such as concentrated floor soap. Generally, the concentrated cleaning agent can be poured into the solution tank 22 and then tap water can be added in the desired amount. The solution tank 22 can be filled with water and concentrated floor soap. When the scrubber is scrubbing, the cleaning fluid 43 can pass from the solution tank 22 through the solution conduit 44 to the brush 28. The cleaning fluid can then be scrubbed against the floor 30 by the rotating bristles 25 of the brush 28. As the scrubber 20 moves forward as indicated by the arrow 52, the squeegee 34 can suck up the dirty fluid 41 from the floor 30 and the dirty fluid can be directed through the conduit 32 into the recovery tank 24.

As illustrated in FIG. 1 the scrubber 20 has just begun a shift and there is more cleaning solution 43 in the solution tank 22, as indicated by the fluid level line 54, than dirty fluid 41 in the recovery tank, 24 as indicated by the fluid level line 56. However, when the recovery tank 24 is full as indicated by the dashed fluid level line 58, the solution tank 22 will be empty or nearly empty as indicted by the dashed fluid level line 60. When the recovery tank 24 is full as indicated by the fluid level line 58, a float shut off switch may turn off the vacuum motor 38. The operator therefore knows it is time to take the scrubber to a janitor's closet or other suitable location to drain the recovery tank 24 through the drain 40. The process can then be repeated. The solution tank 22 can be refilled with a mixture of water and concentrated cleaning solution 43 and the scrubber 20 can be taken back to a work area and can recommence scrubbing the floor 30. The batteries 64 are typically recharged overnight after the job is completed.

Most scrubbers, like the scrubber 20, have traction wheels 62 that can facilitate movement of the scrubber to and from the desired work area. Additionally, some scrubbers have a traction motor to power the traction wheels 62. Scrubbers typically include a power supply to power the brush motor 26, the vacuum motor 38, and if so equipped, the traction motor. In an example, the power supply can comprise at least one 6 or 12-volt DC rechargeable battery. In another example, the power supply can comprise 110 volts AC or 220 volts AC power that is transferred from a wall mounted AC receptacle with a long extension cord.

While scrubbing, cleaning solution 43 can pass through the cleaning solution conduit 44 and feed out by gravity to the top of the brush 28. The brush 28 can have a plurality of holes 29 through the top of the brush that allow some of the cleaning solution 43 to pass through the brush to the bristles 25 and the floor 30. Because the brush 28 is typically rotating between about 175-300 RPM, a substantial amount of the cleaning solution 43 can be expelled from the brush 28 by centrifugal force. Consequently, a splash skirt 31 can be provided that surrounds the brush 28 to contain the cleaning solution that is being expelled therefrom.

Figure 2:
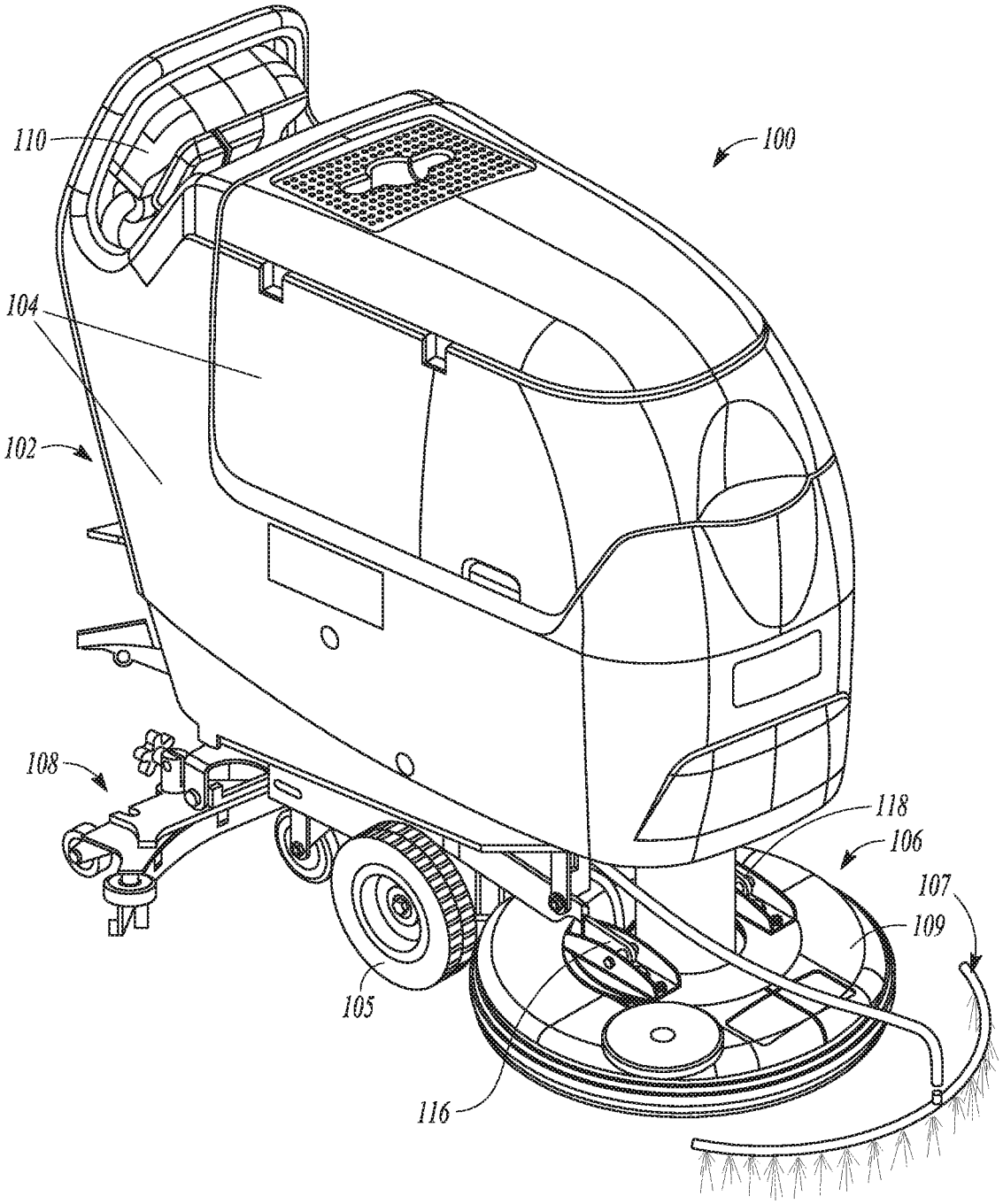
FIG. 2 is a perspective view of an example of a walk-behind random orbit disc scrubber having an arcuate cleaning fluid manifold mounted to the exterior of a cleaning head assembly.

FIG. 2 is a perspective view of an example of a random orbit disc scrubber 100 in accordance with the present application. As illustrated in FIG. 2, the random orbit disc scrubber 100 can generally include a main body 102, a compartment 104 containing a solution tank for dispensing a cleaning fluid, such as a cleaning solution discussed above, and a recovery tank for recovering the cleaning fluid, a random orbit cleaning head assembly 106, a manifold assembly 107, a squeegee assembly 108 operably coupled to a vacuum recovery system, and operator controls 110 for controlling movement and operation of the scrubber 100. As will be discussed in further detail to follow, the manifold assembly 107 can be operable to distribute the cleaning fluid onto one or both of a floor surface and a cleaning element, such as a pad or brush bristles, of the cleaning head assembly 106. Particularly, the cleaning head assembly 106 can impart both rotational and orbital movement on the cleaning element, which can result in a more efficient cleaning process that utilizes less cleaning fluid as compared to prior art systems without sacrificing cleaning quality. Using a plurality of spaced apart nozzles or orifices, such as three or more nozzles or orifices, the manifold assembly 107 can distribute cleaning fluid in desired amounts conducive to cleaning at locations along the perimeter of the cleaning element where the cleaning fluid can be more efficiently used by the cleaning element, thereby reducing waste and splashing. The soiled cleaning fluid can be recovered by the squeegee assembly 108 and directed into the recovery tank by the vacuum recovery system. Movement of the scrubber 100 can be initiated by drive wheels 105 that are operable to drive the scrubber 100 during a scrubbing procedure.

Figure 3:
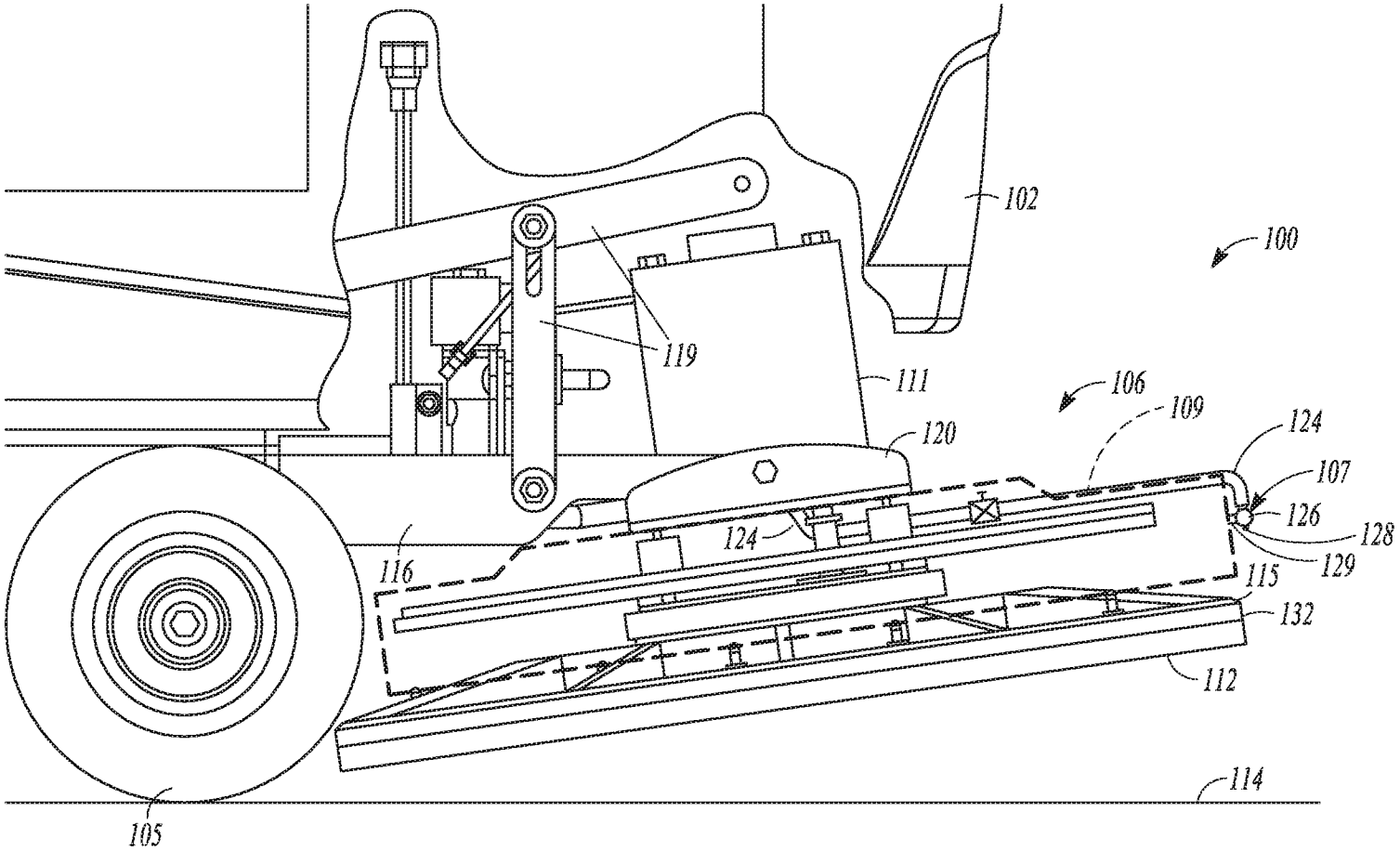
FIG. 3 is a partial side view of the random orbit disc scrubber of FIG. 2 with the cleaning head assembly in a raised position illustrating various components of the cleaning head assembly such as a housing, a motor mounting plate, a driver and a cleaning element.
Figure 4:
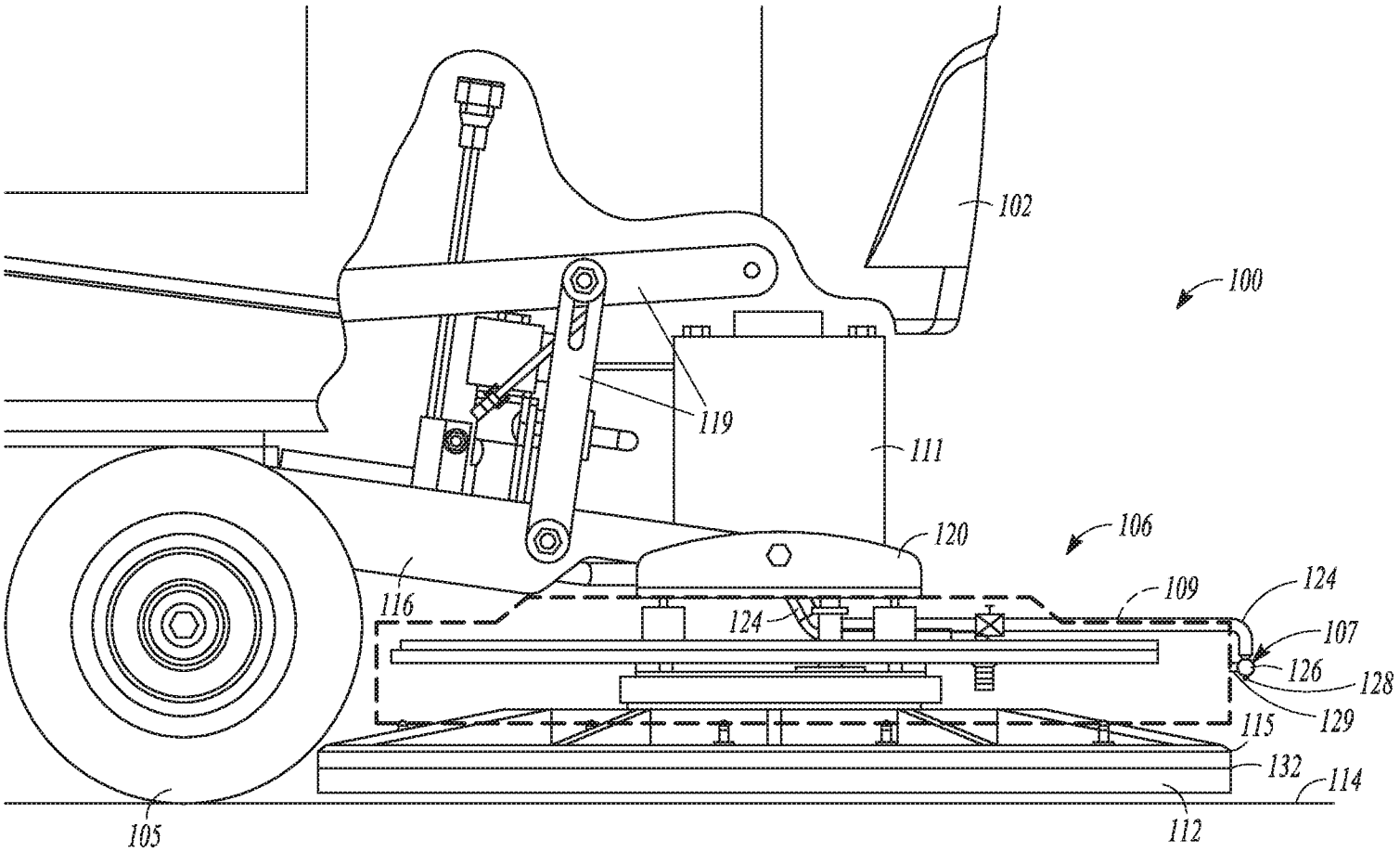
FIG. 4 is a partial side view of the random orbit disc scrubber of FIG. 3 with the cleaning head assembly in a lowered position such that the cleaning element contacts a floor.

FIG. 3 is a partial side view of the scrubber 100 with the cleaning head assembly 106 in a raised position above the floor surface 114. FIG. 4 is a partial side view of the scrubber 100 with the cleaning head assembly 106 in a lowered position to contact the floor surface 114. FIGS. 3 and 4 are discussed concurrently.

FIG. 3 is a partial side view of the scrubber 100 with a portion of the main body 102 removed to illustrate various components of the cleaning head assembly 106 and its attachment to the main body 102. A housing 109 of the cleaning head assembly 106 is also shown in broken lines to allow visualization of the cleaning head assembly components. As illustrated in FIG. 3, the cleaning head assembly 106 can include a motor 111 that imparts both rotational and orbital movement on a suitable cleaning element 112 that can be structured for contact with a floor surface 114. Particularly, the rotational and orbital movement can be transferred to the cleaning element 112 via a rotatable and orbitable driver 115 that can be driven by the motor 111 as will be discussed in further detail to follow.

As used herein, the term "cleaning element" includes cleaning pads, bristles of cleaning brushes, and the like. The cleaning element can be both removable and flexible, such as a flexible cleaning pad. Although any suitable cleaning pad can be used as the cleaning element 112, exemplary cleaning pads can include the high productivity pad 7300, the black stripper pad 7200, the eraser pad 3600, the red buffer pad 5100, and the white super polish pad 4100 sold by 3M Company of St. Paul, Minn. Cleaning pads can be mounted to pad holders and cleaning brushes can be mounted to brush blocks. The pad holders and brush blocks, collectively referred to as drivers, can facilitate coupling to a drive element such as a motor.

Figure 6:
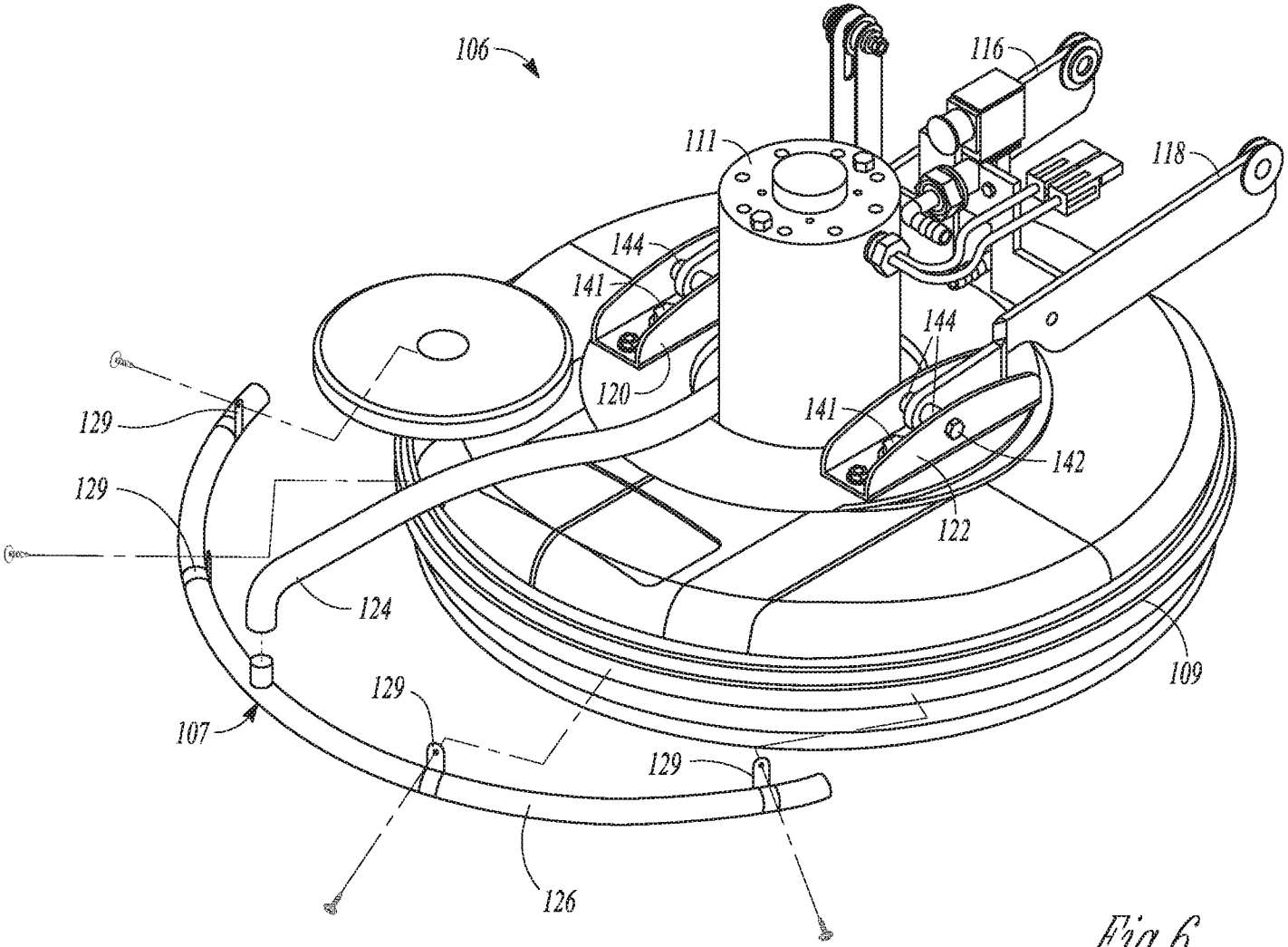
FIG. 6 is a perspective view of the cleaning head assembly of FIGS. 3 and 4 isolated from the remainder of the random orbit disc scrubber to show the arcuate cleaning fluid manifold of FIG. 1 in an exterior-mounted configuration.

The random orbit disc scrubber 100 can include a right lift arm 116 and a left lift arm 118 that pivotally engage a right lift bracket 120 and a left lift bracket 122 (as better illustrated in FIG. 6). The right and left lift arms 116 and 118 (FIG. 2) can be operable to move the cleaning head assembly 106 between a raised position, as shown in FIG. 3, and a lowered position, as shown in FIG. 4. As appreciated by those skilled in the art, the cleaning head assembly 106 can be placed in the raised position of FIG. 3 when the scrubber 100 is not in use or is being driven to the cleaning location and the lowered position of FIG. 4 for engaging and scrubbing the floor surface 114.

The right and left lift arms 116 and 118 can be configured to raise and lower the cleaning head assembly 106 between the positions illustrated in FIGS. 3 and 4 in response to a user-operated actuator. In an example, a foot pedal located at the rear of the scrubber 100 can be actuated to raise and lower the cleaning head assembly 106 via a right linkage assembly 119. In an example, a left linkage assembly (not shown) can also be used. However, any suitable raising and lowering mechanism can be employed.

As illustrated in FIG. 3, the manifold assembly 107 can include a fluid conduit 124, a manifold housing 126, a nozzle 128 and a mounting bracket 129. The fluid conduit 124 of manifold assembly 107 can run from the solution tank (not shown) to a manifold housing 126 positioned near the front side of the cleaning head assembly 106 for controllably dispensing the cleaning fluid onto the cleaning element 112 and the floor surface 114. In an example, the cleaning fluid can be pumped from the solution tank through the fluid conduit 124 to the manifold housing 126 such that the cleaning fluid sprays through the nozzles 128 at a desired pressure. In an example, the cleaning fluid can run by gravity from the solution tank through the fluid conduit 124 to the manifold housing 126 such that the cleaning fluid drips from nozzles 128 at ambient pressure. Manifold housing 126 can include multiple nozzles 128 that permit cleaning fluid to drip or spray onto floor 114 in multiple locations in front of the rotating cleaning element 112. In various embodiments, nozzles 128 can comprise variable flow nozzles, such as those described with reference to FIGS. 20A and 20B. In various examples, manifold housing 126 can include simple through-bores (as discussed with reference to FIG. 13) instead of the nozzles 128 to permit the cleaning fluid to pass through the manifold housing 126. In examples, the nozzles 128 or the through-bores can be oriented to dispense cleaning fluid in a direction straight down to the floor surface 114 or backward to the cleaning element 112.

From time to time, cleaning elements wear out or become damaged and thus need to be replaced. Additionally, it may be necessary to change the type of cleaning element to better suit a particular cleaning application, such as by replacing a cleaning pad with a cleaning brush. In an example, the cleaning elements 112 can be removed and installed without the use of tools thus making it easy to replace a cleaning element. As illustrated in FIG. 3, the cleaning element 112 can be removably coupled to the driver 115 with an attachment means 132. For example, the attachment means 132 can comprise a hook and loop type attachment means. However, any suitable attachment means that can removably and securely hold the cleaning element 112 to the driver 115 can be used including, but not limited to, an adhesive, snap members, latches, threaded fasteners, or the like. As will be appreciated by those skilled in the art, the attachment means 132 can be formed as a separate component from the driver 115 or integral with the driver 115 without departing from the intended scope of the present application. Forming the attachment means 132 separate from or integral with the driver 115 is merely a matter of design choice.

Figure 5:
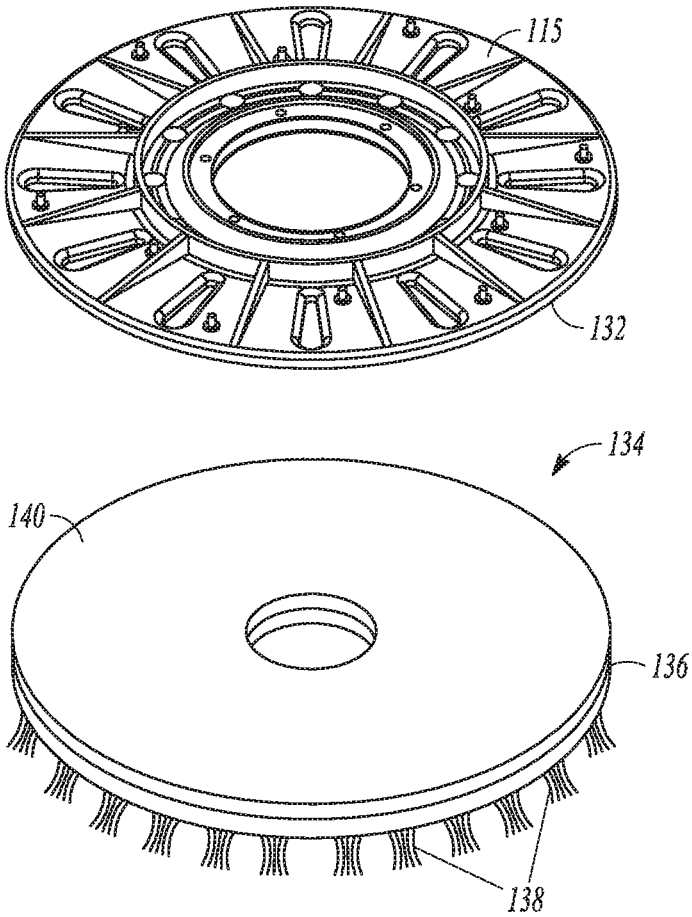
FIG. 5 is a perspective exploded view of the driver and the cleaning element useable in the cleaning head assembly of FIGS. 3 and 4.

FIG. 5 is a perspective view of the driver 115 and removable cleaning brush 134. As discussed above, the cleaning element 112 can take on numerous forms including a cleaning pad and bristles of a cleaning brush. As illustrated in FIG. 5, the driver 115 includes the attachment means 132, which can be a hook and loop type fastener or other suitable device. The removable cleaning brush 134 can include a flexible sheet 136 with bristles 138 extending from one side and a pad 140 located on the opposite side. The flexible sheet 136 can be formed from any suitable material, such as plastic or nylon. In alternative embodiments, the sheet 136 can be rigid rather than flexible. The pad 140 can be structured to removably engage the attachment means 132 on the driver 115.

FIG. 6 is a perspective view of the cleaning head assembly 106 isolated from the remainder of the scrubber 100. As illustrated in FIG. 6, the right and left lift brackets 120 and 122 can be coupled to the housing 109 of the cleaning head assembly 106 in any suitable manner, such as with one or more fasteners 141. As further illustrated in FIG. 6, the right and left lift arms 116 and 118 can be hingedly coupled to the right and left lift brackets 120 and 122, respectively, with a suitable pin or bolt 142. Lateral movement of the right and left lift arms 116 and 118 at the hinged connection point can be prevented or minimized by the placement of spacers 144 on one or both sides of the lift arms. Together, the right and left lift arms 116 and 118 can raise and lower the cleaning head assembly 106 from the lower scrubbing position of FIG. 4 to the upper position of FIG. 3 as previously discussed.

The manifold assembly 107 is also shown in FIG. 6 with the manifold housing 126 being attached to the housing 109 using a plurality of brackets 129. The manifold housing 126 may comprise any suitable vessel, reservoir or container for receiving cleaning fluid. For example, the manifold housing 126 can be fabricated from a length of pipe, tubing, hose or conduit. Ends of the vessel can be closed-off, such as with threaded or welded caps or plugs. The manifold housing 126 can be shaped or formed to have a curvature that matches the curvature of the housing 109. In an example, the manifold housing 126 can comprise a copper tube having a plurality of 1.65 mm diameter through-bores that is bent to have a circular radius of curvature. The brackets 129 can comprise any suitable device or component for securing the manifold housing 126 to the housing 109 of the cleaning head assembly 106. For example, the brackets 129 can comprise plastic straps wrapped around the manifold housing 126 that are fastened to the housing 109 such as with threaded fasteners or rivets. In another example, the brackets 129 can comprise metal angle arms that are welded to the housing 109 and the manifold housing 126.

Figure 7:
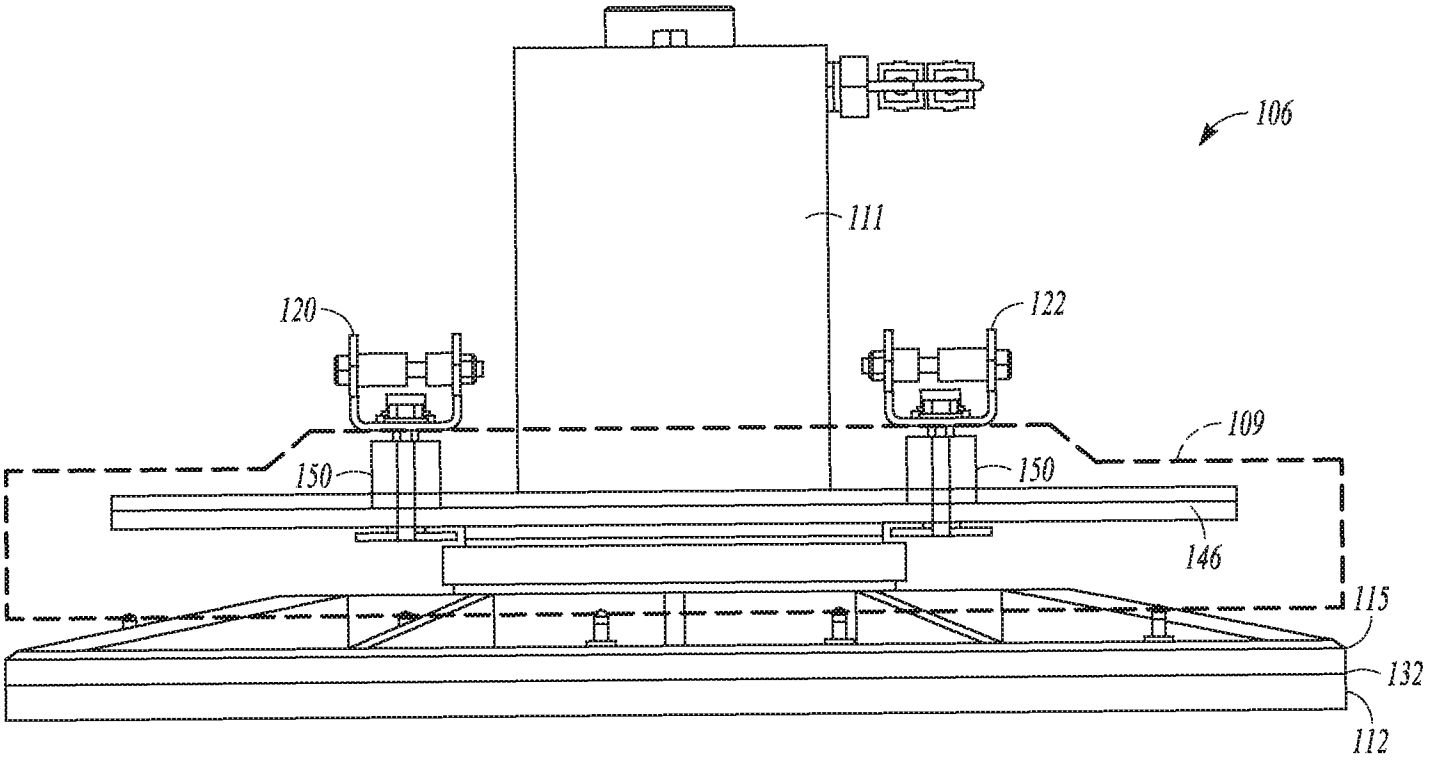
FIG. 7 is a front view of the cleaning head assembly of FIGS. 3 and 4 showing the motor mounting plate and the driver.

FIG. 7 is a front view of the cleaning head assembly 106 isolated from the remainder of the scrubber 100 to better show the components of the cleaning head assembly 106, such as the motor mounting plate 146 and the driver 115.

Once again, the housing 109 of the cleaning head assembly 106 is shown in broken lines to allow visualization of the various cleaning head components. As illustrated in FIG. 7, the motor 111 can be mounted on the motor mounting plate 146. Prior art rotary motion scrubbers such as that illustrated in FIG. 1 typically utilize cleaning elements that rotate about the centerline of the motor driveshaft. This produces purely rotational movement of the cleaning element. However, the random orbit disc scrubber 100 of the present application provides a cleaning element 112 that can rotate and orbit about the centerline of the drive shaft of the motor 111.

Figure 9:
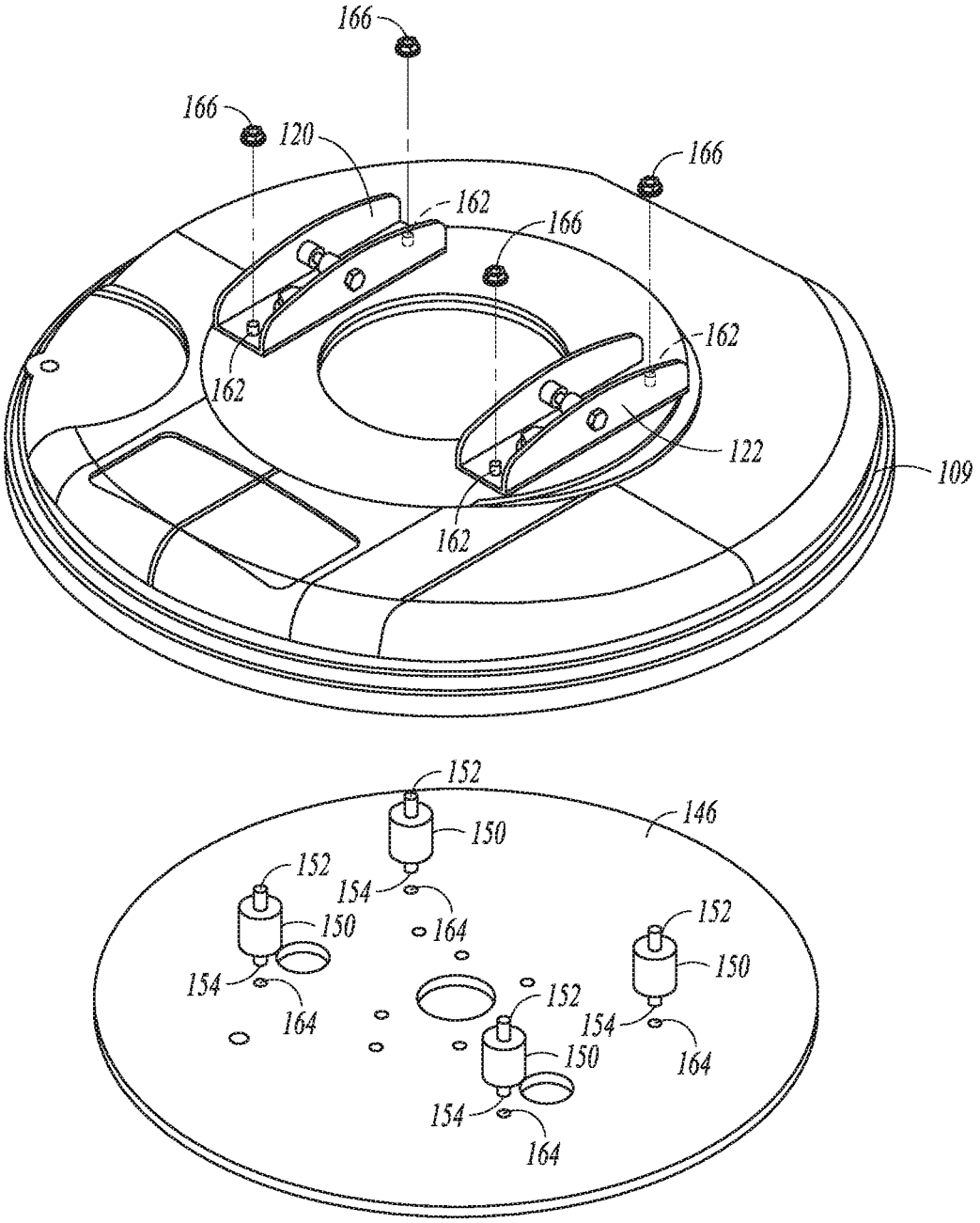
FIG. 9 is an exploded perspective view of the motor mounting plate and the housing of the cleaning head assembly illustrating exemplary positioning and connection of vibration dampening elements of FIG. 8.

As will be described in further detail with reference to the following figures, the orbital movement can be imparted to the cleaning element 112 by an eccentric cam operably coupled to the driveshaft of the motor 111. The cleaning element 112 can orbit at speeds exceeding 2000 revolutions per minute, which induces vibrations in the cleaning head assembly 106. In order to extend the life of the scrubber 100 and improve operator comfort, these vibrations are preferably dampened. To that end, as illustrated in FIG. 7, a plurality of vibration dampening elements 150 can be positioned between the motor mounting plate 146 and the right and left lift brackets 120 and 122. As best illustrated in FIG. 9, four vibration dampening elements 150 can be disposed between each of the lift brackets 120 and 122 and the motor mounting plate 146. Because the driver 115 and the cleaning element 112 are structured to rotate independent of the orbital movement, vibration dampening is provided only in the "upper" region of the cleaning head assembly 106 between the lift brackets 120 and 122 and the motor mounting plate 146 and not in the "lower" region of the cleaning head assembly 106 between the motor mounting plate 146 and the driver 115.

Figure 8:
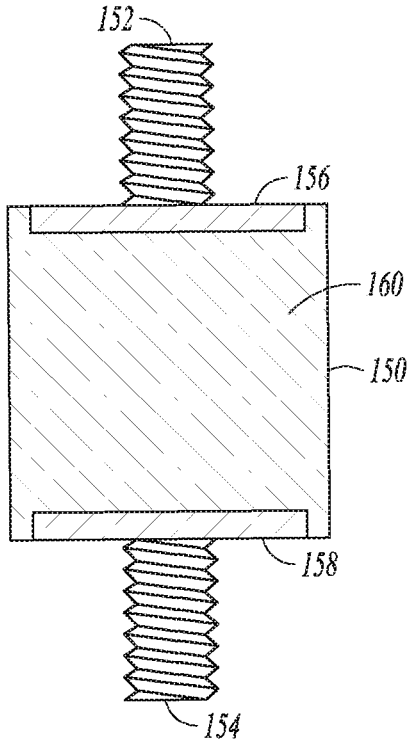
FIG. 8 is a cross-sectional view of an exemplary vibration dampening element that can be used in the cleaning head assembly.

FIG. 8 is a cross-sectional view of one of the vibration dampening elements 150 of FIG. 7. As illustrated in FIG. 8, the vibration dampening element 150 can include an upper threaded shaft 152 and a lower threaded shaft 154. The upper threaded shaft 152 can extend from an upper support plate 156 and the lower threaded shaft 154 can extend from a lower support plate 158. The body 160 of the vibration dampening element 150 can be formed from any suitable material, such as a natural rubber with a durometer of about 40. However, numerous other ratings are also possible. Additionally, various man-made elastomers can also be suitable for the vibration dampening elements 150. Other types of vibration dampening elements can also be suitable as long as they are deformable or have some degree of flexibility to allow dampening of the vibrations. For example, metal springs can be used in place of a natural rubber or man-made elastomer material to dampen the system vibrations during operation.

FIG. 9 is an exploded perspective view of the housing 109, right and left lift brackets 120 and 122, and the motor mounting plate 146 further illustrating the positioning and connection of the vibration dampening elements 150. Particularly, as illustrated in FIG. 9, the upper threaded shaft 152 of each of the vibration dampening elements 150 can be structured to be received within a corresponding aperture in the housing 109 (not shown) and an aperture 162 in the right and left lift brackets 120 and 122. Similarly, the lower threaded shaft 154 of each of the vibration dampening elements 150 can be structured to be received within a corresponding aperture 164 in the motor mounting plate 146. The upper threaded shafts 152 can be secured to the right and left lift brackets 120 and 122 with any suitable fastening means, such as with a corresponding plurality of internally threaded nuts 166 that are structured to threadably engage the upper threaded shafts 152. Although not shown, a similar type of fastening means can be used to secure the lower threaded shafts 154 to the motor mounting plate 146. Furthermore, although threaded shafts and nuts are described as the dampening element fastening means, those skilled in the art will appreciate that any suitable means of fastening the vibration dampening elements 150 between the lift brackets 120 and 122 and the motor mounting plate 146 can be used without departing from the intended scope of the present application.

As will be appreciated by those skilled in the art in view of the foregoing, the vibration dampening elements 150 can reduce sound and vibration between the motor mounting plate 146, the housing 109, and the right and left lift brackets 120 and 122. Additionally, the vibration dampening elements 150 can also allow the cleaning head assembly 106 to move and conform to variations in floor elevation relative to the machine body. This prevents uneven loading of the cleaning head assembly 106 which would otherwise result in increased vibration. The ability of the cleaning head assembly 106 to conform to variations in floor elevation can also result in a more uniform cleaning of the floor surface.

While the structure and positioning of exemplary vibration dampening elements 150 has been described in detail, those skilled in the art will appreciate that the number, location, and type of vibration dampening elements can vary according to the size of the motor 111, the size of the cleaning element 112, and the size of the driver 115, among other factors.

Figure 10:
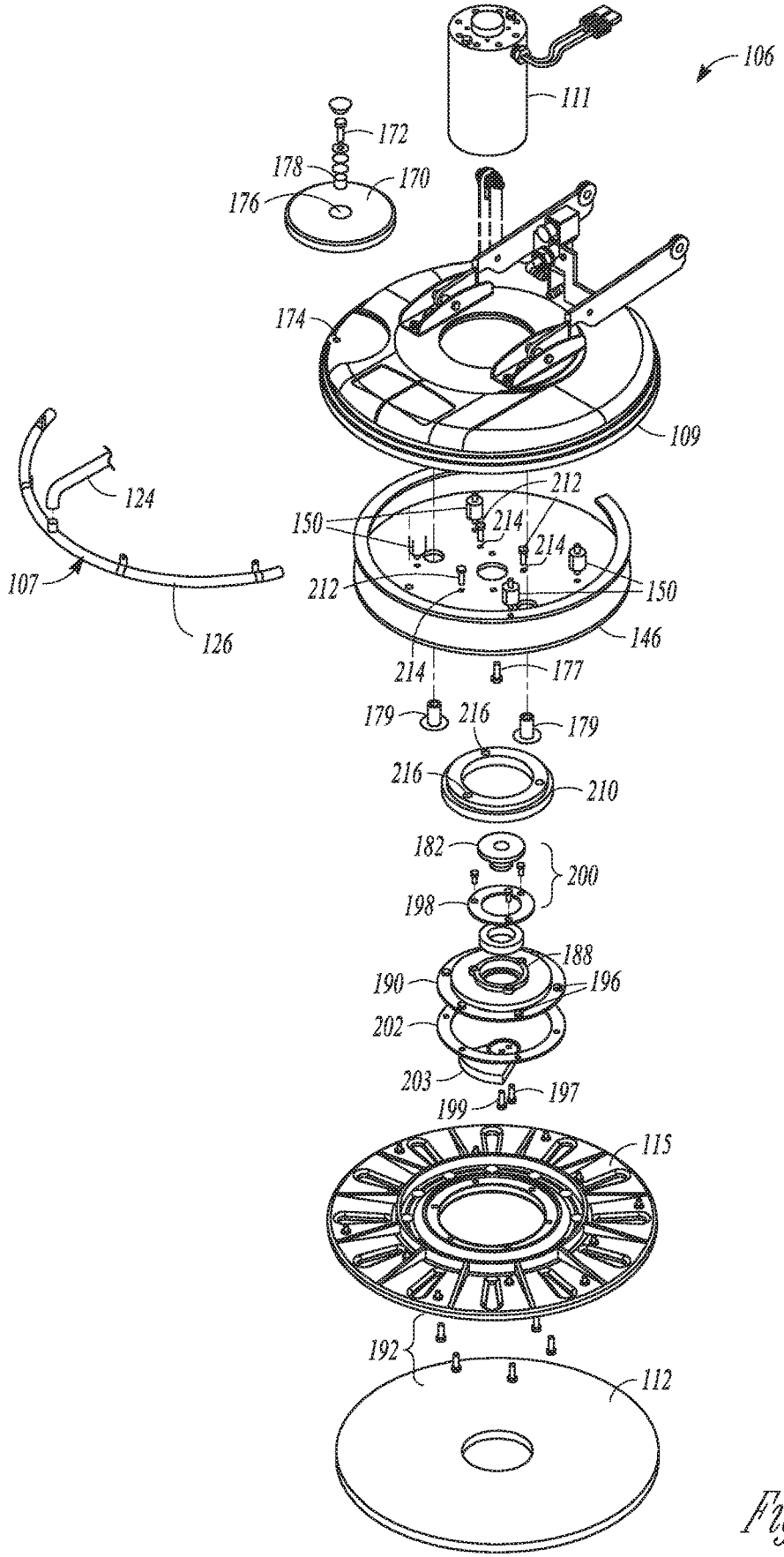
FIG. 10 is an exploded perspective view of the entire cleaning head assembly including the arcuate cleaning fluid manifold mountable to the housing forward of the cleaning element.
Figure 11:
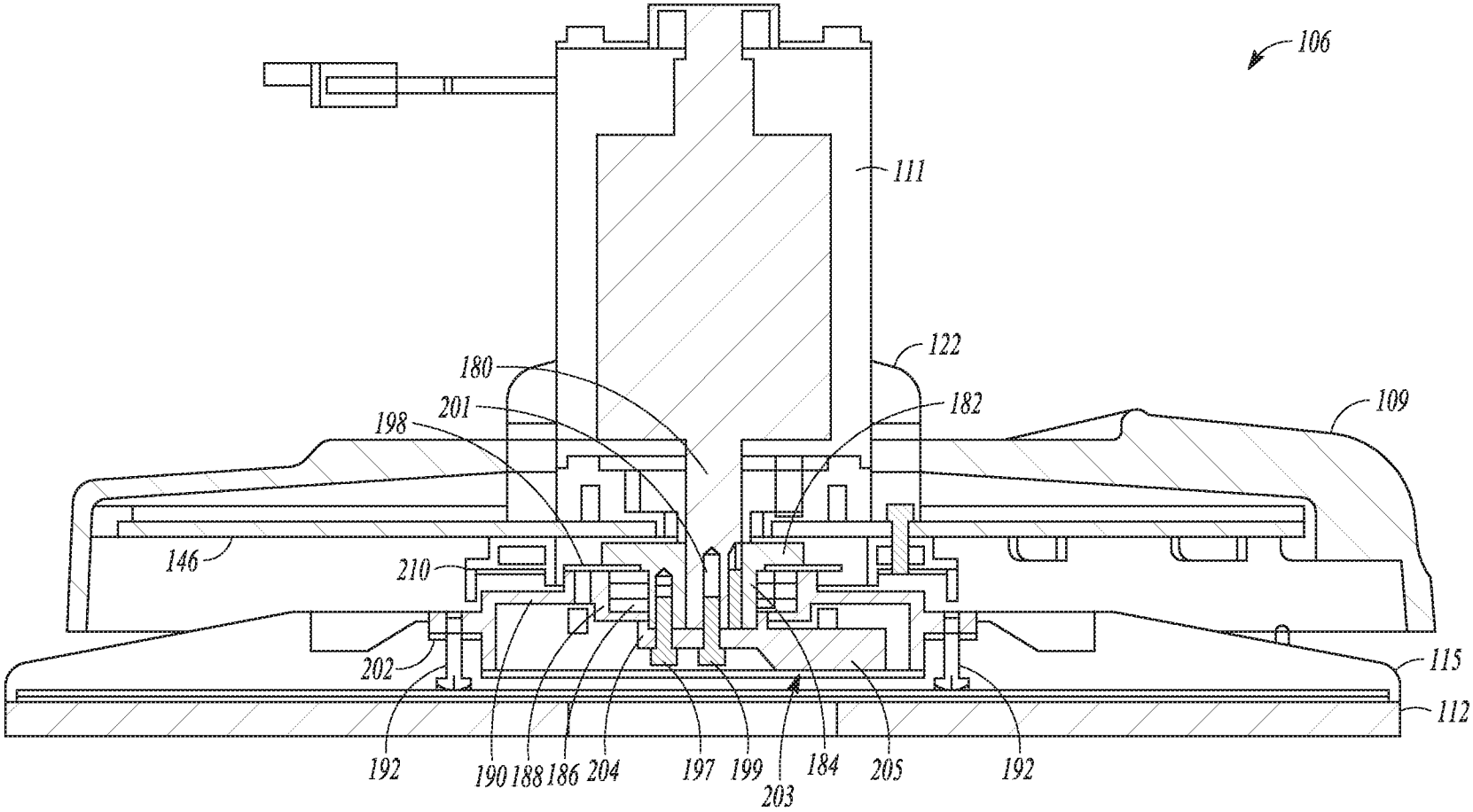
FIG. 11 is a side cross-sectional view of the cleaning head assembly of FIGS. 3 and 4 illustrating operation of an eccentric cam coupling a motor drive shaft and a motor drive plate.

FIG. 10 is an exploded perspective view of the cleaning head assembly 106. FIG. 11 is a side cross-sectional view of the cleaning head assembly 106. Together, the exploded view of FIG. 10 and the cross-sectional view of FIG. 11 illustrate the structure and function of the various cleaning head assembly components. FIGS. 10 and 11 are discussed concurrently.

As will be appreciated by those skilled in the art, the motor mounting plate 146 and the housing 109 remain stationary relative to the motor 111 during a scrubbing procedure. Particularly, the motor mounting plate 146 can be fixedly coupled to the motor 111 in any suitable manner, such as with a plurality of threaded fasteners 177 (only one shown in FIG. 10) structured to be received within a corresponding plurality of threaded apertures in the motor 111. Similarly, the motor mounting plate 146 can be fixedly coupled to the housing 109 in any suitable manner, such as with a plurality of bolts 179. The housing 109 and the motor mounting plate are stationary and thus provide a suitable location for the mounting of the manifold assembly 107 to the cleaning head assembly 106. However, the manifold assembly 107 can be mounted in other locations, such as on a chassis of the cleaning machine or on a rotatable carriage coupled to the cleaning head assembly.

The motor 111 can be operable to cause a drive shaft 180 to rotate. The drive shaft 180 can be structured for mounting off-center in an eccentric cam 182, as best illustrated in FIG. 11. An extension shaft 184 extends from and can be integral with the eccentric cam 182. A suitable bearing assembly 186 can be press-fit into a journal 188 of a motor driver plate 190, which in turn can coupled to the driver 115 with a plurality of fasteners 192 structured to pass through a plurality of apertures 194 along an inner radius of the driver 115 and a corresponding plurality of apertures 196 along an outer radius of the motor driver plate 190. A retaining ring 198 can be fastened to a top side of the motor driver plate 190 with a plurality of fasteners 200 to retain the bearing assembly 186 within the journal 188 of the motor driver plate 190. Optionally, a suitable gasket 202 can be fastened between the driver 115 and the motor driver plate 190 to help prevent cleaning fluid from entering into the driver 115, dampen vibrations, and provide a secure connection.

When assembled as illustrated in FIG. 11, the extension shaft 184 of the eccentric cam 182 can be structured to contact the internal raceway of the bearing assembly 186. A bolt 199 can threadably engage an aperture 201 in the drive shaft 180 of the motor 111. When the motor 111 is "on" the drive shaft 180 can rotate the eccentric cam 182 which imparts orbital movement to the driver 115 due to the off-center position of the drive shaft 180 in the eccentric cam 182. Stated alternatively, the longitudinal center axis of the drive shaft 180 and the longitudinal center axis of the extension shaft 184 of the eccentric cam 182 are not in alignment which imparts the orbital movement on the driver 115. In an example, the longitudinal center axis of the drive shaft 180 can be "off-centered" from the longitudinal center axis of the extension shaft 184 by an amount equal to about ⅛", thereby producing small orbits of about ¼" in diameter. However, the ⅛" offset is presented merely for purposes of example and not limitation. Thus, any suitable offset can be used to produce orbital movement of the driver 115 and the cleaning element 112 as will be appreciated by those skilled in the art.

As discussed above, the driver 115 can be fixedly coupled to the motor driver plate 190, which can be rotatable relative to the eccentric cam 182 due to the presence of the bearing assembly 186 in the driver plate journal 188. Thus, the driver 115 and attached cleaning element 112 also rotate independently of the orbital movement provided by the offset in the eccentric cam 182. In an example, rotation of the drive shaft 180 at a speed of about 2200 revolutions per minute can produce circumferential rotation of the driver 115 and attached cleaning element 112 at a speed of about 30 revolutions per minute. This additional circumferential rotation can provide better distribution of the cleaning fluid, better cleaning action (especially with a brush application), and improved debris deflection as compared to a purely orbitable cleaning element. As those skilled in the art will appreciate, debris would have more of a tendency to build-up on the non-rotating edge of a purely orbitable cleaning element.

The rotational speed of the driver 115 and cleaning element 112 can be significantly slower than a conventional prior art rotary disc scrubber such as that illustrated in FIG. 1, which can rotate at a speed between about 175-300 revolutions per minute. Such conventional rotary disc scrubber machines tend to expel cleaning fluid several inches past the perimeter of the cleaning element thereby requiring skirts (such as splash skirt 31 of FIG. 1) around the scrubber deck to prevent solution from splashing onto baseboards and extending beyond the reach of the squeegee. The amount of cleaning fluid expelled by the cleaning head assembly 106 of the present application is insignificant due to the slower circumferential rotation of the driver 115 and cleaning element 112, thus making a splash skirt unnecessary.

As will be appreciated by those skilled in the art, rotating the driver 115 at high speeds to produce the desired orbital movement generates a centripetal force that must be counteracted in order to provide a balanced rotation. Thus, as illustrated in FIGS. 10 and 11, a counterweight 203 can be provided that includes a connection sleeve 204 structured to receive a bottom portion of the extension shaft 184 of the eccentric cam 182 and a main body 205 that provides a region of concentrated mass. The counterweight 203 can be fastened to the drive shaft 180 of the motor 111 with the bolt 199. A second bolt 197 can be provided to fasten the counterweight 203 to the eccentric cam 182. Consequently, the drive shaft 180, the eccentric cam 182, and the counterweight 203 move together in unison.

The counterweight 203 acts as the balancing force to the centripetal force generated by the driver 115. Particularly, the main body 205 of the counterweight 203 can act in a direction that is directly opposite and generally in-line with the force being generated by the driver 115. In other words, the center of mass of the counterweight 203 can be positioned such that it is generally in-line with the center of mass of the driver 115. Any significant offset between these two lines of forces would generate a torque or couple on the drive shaft 180, thus creating vibration in the system. As further illustrated in FIG. 11, the cleaning head assembly 106 can be designed with the counterweight 203 located inside the driver 115 in order to reduce the torque on the drive shaft 180 and the scrubber 100 as a whole. Placing the counterweight at another location, such as above the driver 115 and the eccentric cam 182, would generate a moment on the system and result in undesirable loading.

A stationary splash shield 210 can be fixedly coupled to the motor mounting plate 146 with a plurality of fasteners 212 that extend through a plurality of apertures 214 in the motor mounting plate 146 and a corresponding plurality of apertures 216 in a top side of the splash shield 210. As will be appreciated by those skilled in the art, the splash shield 210 can be sized such that it encloses the distal end of the drive shaft 180, the eccentric cam 182, and the bearing assembly 184 to prevent cleaning fluid from coming into contact with these components during operation.

In order to protect the cleaning head assembly 106 and to avoid damage to walls and furniture, the cleaning head assembly 106 can be equipped with one or more roller bumpers 170. As best illustrated in FIG. 10, the roller bumper 170 can be secured to the housing 109 with a bolt 172 that passes through an aperture 174 in the housing 109 and an aperture 176 in the center of the roller bumper 170. A nut 178 can be provided that threads onto the extended portion of the bolt 172 to secure the roller bumper 170 to the housing 109 while at the same time allowing the roller bumper 170 to freely rotate about the bolt 172. The roller bumper 170 can be sized to extend beyond the housing 109, as better seen in FIG. 6, such that it can bump and rotate against walls, furniture, and other fixtures so as to protect the cleaning head assembly 106. Additionally, the roller bumper 170 can help to prevent scrapes and scratches on walls and other fixtures when the cleaning head assembly 106 inadvertently contacts a wall or fixture.

Figure 12:
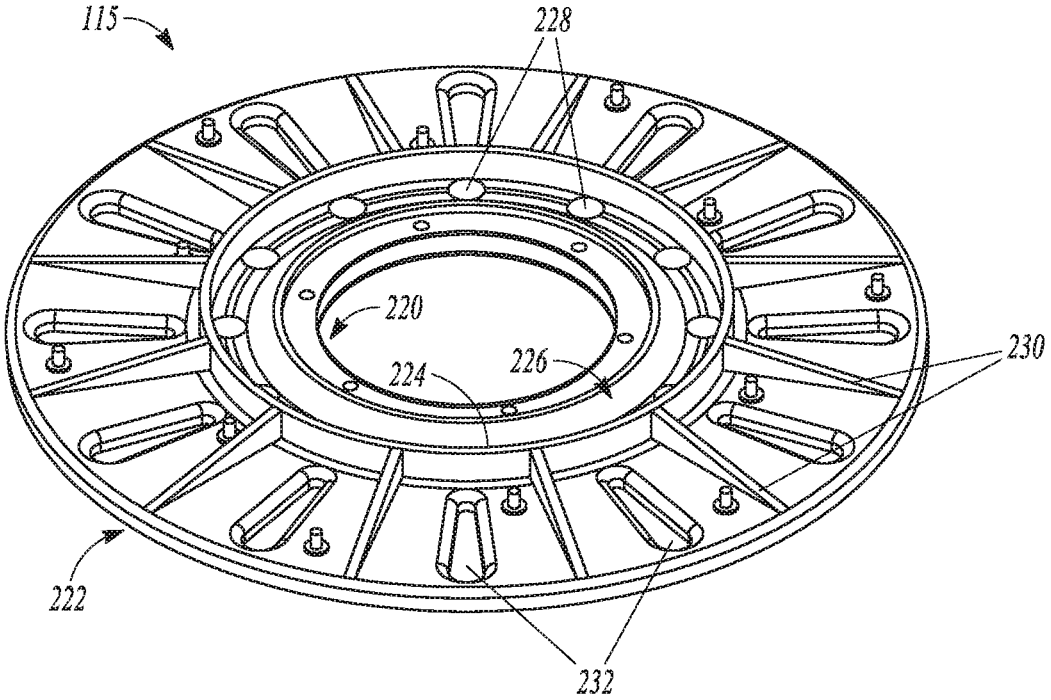
FIG. 12 is a perspective view of the driver illustrating various design features of the driver, such as apertures that permit cleaning fluid to pass through the driver.

FIG. 12 is a perspective view of the driver 115 illustrating various design features of the driver 115. As illustrated in FIG. 12, the driver 115 can include an inner region 220 and an outer region 222 separated by a circumferential ridge 224. The outer region 222 of the driver 115 includes a plurality of circumferentially spaced ribs 230 that are structured to provide rigidity to the driver 115. As further illustrated in FIG. 12, the outer region 222 can include a plurality of suitably sized slots 232 for reducing the weight of the driver 115. Those skilled in the art will appreciate that reducing the weight of the driver 115 can correspondingly reduce the size of the counterweight that is required to balance the various forces in the system.

The inner region 220 can define a trough 226 having a plurality of apertures 228. A total of 12 apertures 228 are illustrated, although the driver 115 can have any number of apertures without departing from the intended scope of the application. In various configurations, such as discussed below with reference to FIG. 16, the apertures 228 and the slots 232, or any other hole, bore or passage through the driver 115, can be used for dispensing the cleaning fluid to the cleaning element 112; particularly, cleaning fluid can be delivered through the fluid conduit 124, the manifold housing 126 and nozzles 128 to the trough 226 where it can be funneled through the apertures 228 and onto the rotating cleaning element 112. However, in the embodiment of FIGS. 2-12, the apertures 228 are not used for direct reception of cleaning fluid, and the manifold housing 126 is mounted out front of the driver 115.

Figure 13:
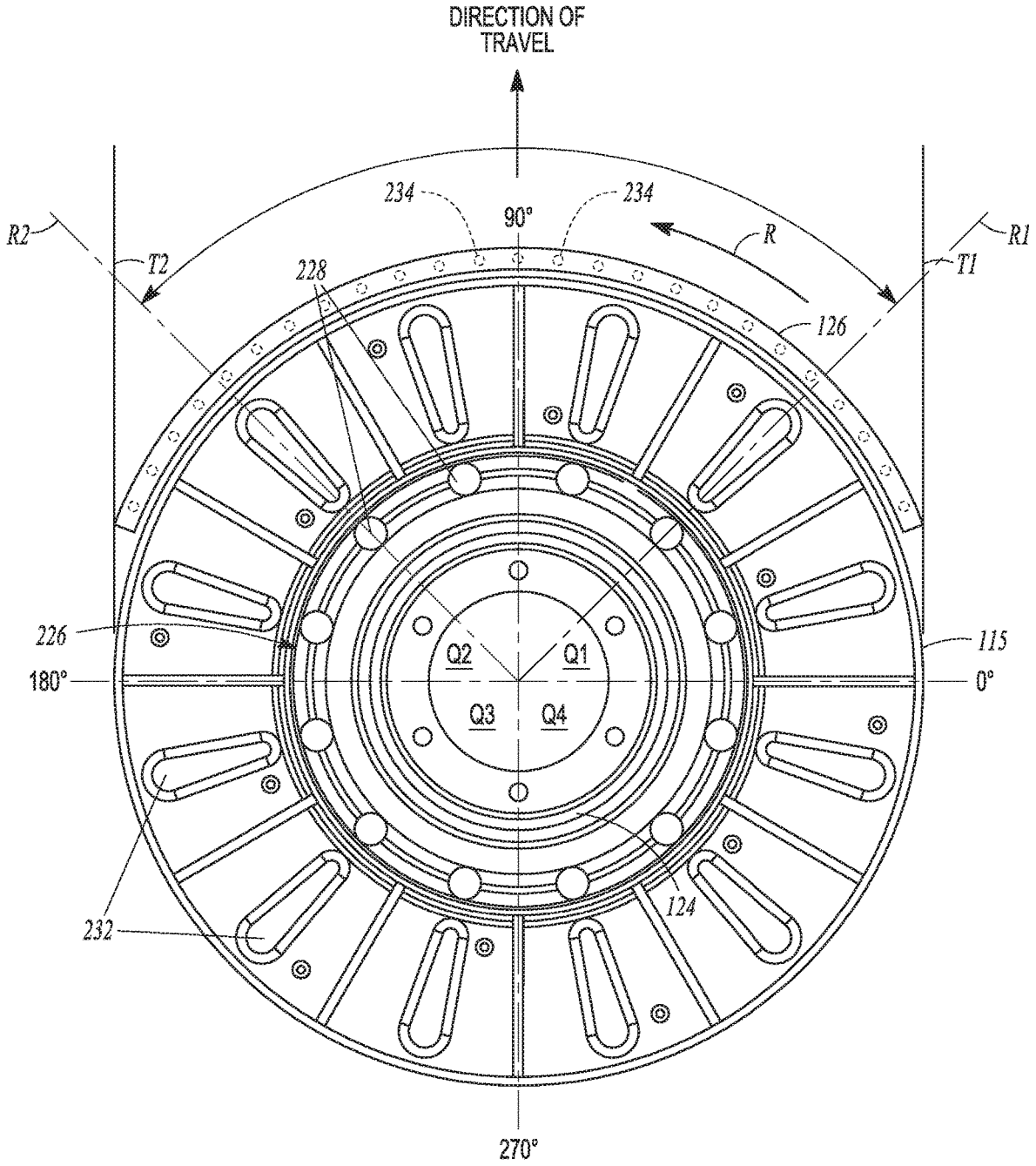
FIG. 13 is a diagram illustrating a top view of the driver of FIG. 12 showing an example location for the arcuate cleaning fluid manifold relative to the geometry of the driver and the presence of multiple cleaning fluid orifices in the arcuate manifold.

FIG. 13 is a diagram illustrating a top view of the driver 115 showing the dispensing location of the cleaning fluid from the manifold housing 126 and nozzles 128. Particularly, it is assumed that the direction of travel is oriented toward the top of the page as shown, and the direction of rotation R of the driver 115 is counterclockwise. In order to more clearly describe the dispensing location, the diagram has been divided into four quadrants including a first quadrant Q1 (i.e., 0-90 degrees), a second quadrant Q2 (i.e., 90-180 degrees), a third quadrant Q3 (i.e., 180-270 degrees), and a fourth quadrant Q4 (i.e., 270-360 degrees). Alternatively, the first quadrant Q1 can be described as the front right quadrant as viewed from the top of the driver 115, the second quadrant Q2 can be described as the front left quadrant as viewed from the top of the driver 115, the third quadrant Q3 can be described as the back left quadrant as viewed from the top of the driver 115, and the fourth quadrant Q4 can be described as the back right quadrant as viewed from the top of the driver 115. Right corresponds to the right hand side of the machine as viewed from the operator position and front corresponds to the direction of travel during cleaning.

In the example of FIG. 13, the dispensing location can be in both the first or front right quadrant Q1 and the second or front left quadrant Q2, as viewed from the top of the driver 115 when the driver 115 is rotating in the counterclockwise direction. Particularly, it has been found that dispensing the cleaning fluid from the manifold housing 126 across the front of both quadrant Q1 and quadrant Q2 can distribute the cleaning fluid across substantially the full area of the cleaning element 112 without expelling any significant amount of solution outside of the cleaning head assembly 106. Thus, positioning the manifold housing 126 in the proper location can be instrumental in operating the scrubber 100 in the most efficient manner and minimizing the amount of cleaning fluid that is necessary in order to clean a desired floor surface.

As will be appreciated by those skilled in the art, if the direction of rotation R of the driver 115 is reversed such that the driver 115 rotates clockwise, the location of manifold housing 126 across both quadrant Q1 and quadrant Q2 as shown in FIG. 13 would additionally provide adequate distribution of cleaning fluid without modification.

FIG. 13 shows tangent lines T1 and T2 for the driver 115. The driver 115 can be configured as a circular body having a diameter. Tangent lines T1 and T2 can be parallel to the 90°-270° axis. The manifold housing 126 can be located fully between tangent lines T1 and T2. As such, cleaning fluid will not be wasted by being dispensed outside of the width of the cleaning element 112.

In another embodiment, the manifold housing 126 can be configured to extend along a particular percentage of the circumference of the driver 115. For example, the manifold housing 126 can be configured to extend along about twenty-five percent of the circumference of the driver 115, such as the front-most portion comprising the inner halves of quadrant Q1 and quadrant Q2, as is indicated by radial lines R1 and R2. In other examples, the manifold housing 126 can extend along the circumference of the driver 115 in the range of approximately forty percent to approximately fifteen percent of the circumference. The depicted embodiment of the manifold housing 126 in FIG. 13 between tangent lines T1 and T2 comprises approximately forty percent of the circumference of the driver 115.

Furthermore, the manifold housing 126 is positioned close to the front of the cleaning element 112 and the driver 115 to minimize cleaning fluid that is inefficiently applied during turning operations of scrubber 100. For example, if a manifold housing were used that is shaped to extend straight between tangent lines T1 and T2, i.e., perpendicular to the 90°-270° axis, cleaning fluid dispensed toward the extremities of such manifold housing would be applied outside of the path of the cleaning element 112 in the direction opposite the direction that the scrubber 100 turns. However, with the manifold housing 126 closely conforming to the shape of the driver 115, waste of cleaning fluid from this type of occurrence is minimized. As discussed below with reference to FIGS. 17, 18A and 18B, the condition can be further mitigated by the use of a rotating manifold.

FIG. 13 additionally shows the location of a plurality of through-bores 234 (shown in phantom) that are located on the underside of manifold housing 126. The through-bores 234 can be used instead of nozzles 128. In the illustrated embodiment, manifold housing 126 includes a plurality of 1.165 mm through-bores 234 that are spaced 1 to 2 inches (~2.54 cm to 5.08 cm) apart. The through-bores 234 can be positioned from proximate an extreme end of the manifold housing 126, e.g., within approximately one inch (~2.54 cm) of the end, to proximate the opposite extreme end.

In operation, the cleaning fluid can be pumped to the manifold assembly 107, above or in front of the driver 115 and the cleaning element 112, via a suitable fluid pump that can be controlled by the operator controls 110. The pump can be controlled to provide the correct proportional amount of water to chemical as directed by the operator. In an example, the cleaning fluid can be gravity fed to the manifold assembly 107, such as by allowing the cleaning fluid to drip into the manifold housing 126. In another example, the manifold housing 126 can include a modulated valve that is operable between an "on" position and an "off" position at suitable intervals. Regardless of the manner in which the cleaning fluid is dispensed onto the driver 115, the cleaning fluid can be substantially evenly distributed across the cleaning element 112 as described herein.

As will be appreciated by those skilled in the art based on the foregoing, the rotational and orbital movement of the cleaning element 112 can entrap the cleaning fluid inside the cleaning element by its small and fast orbiting action and constant velocity directional changes. The manifold assembly 107 can strategically place cleaning fluid on top or in front of the cleaning element 112 to maximize use of all the surface area of the cleaning element 112, thereby improving the overall efficiency of the scrubber 100. Because the cleaning fluid is entrapped within the cleaning element 112, approximately ½ to ¼ the amount of cleaning fluid, or even less, can be required as compared to a traditional rotary disc scrubber for the same amount of cleaning. The combined rotational and orbital movement of the cleaning element 112 can also produce a more uniform scrub pattern without the "swirls" that are often produced by traditional rotary disc scrubbers.

Figure 14:
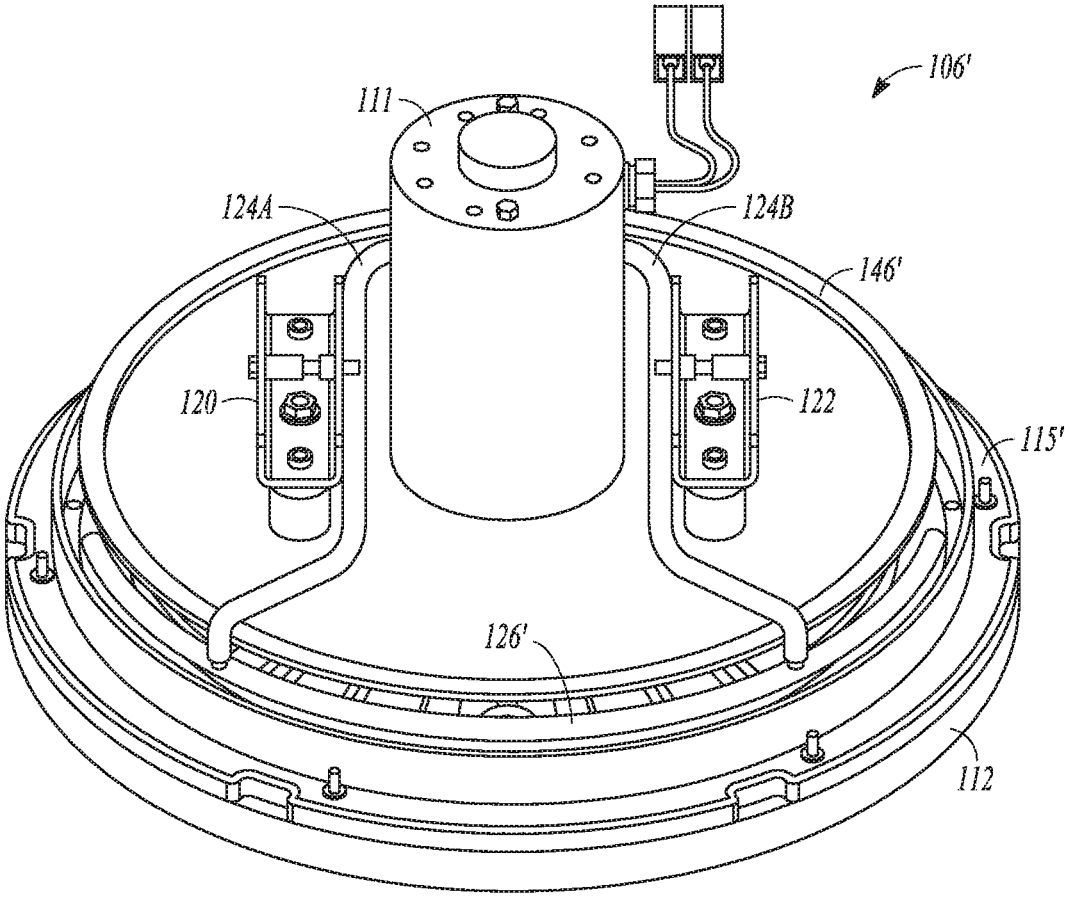
FIG. 14 is a perspective view of another example of a cleaning head assembly having an interior-mounted arcuate cleaning fluid manifold coupled to a motor mounting plate above a cleaning element driver.
Figure 15:
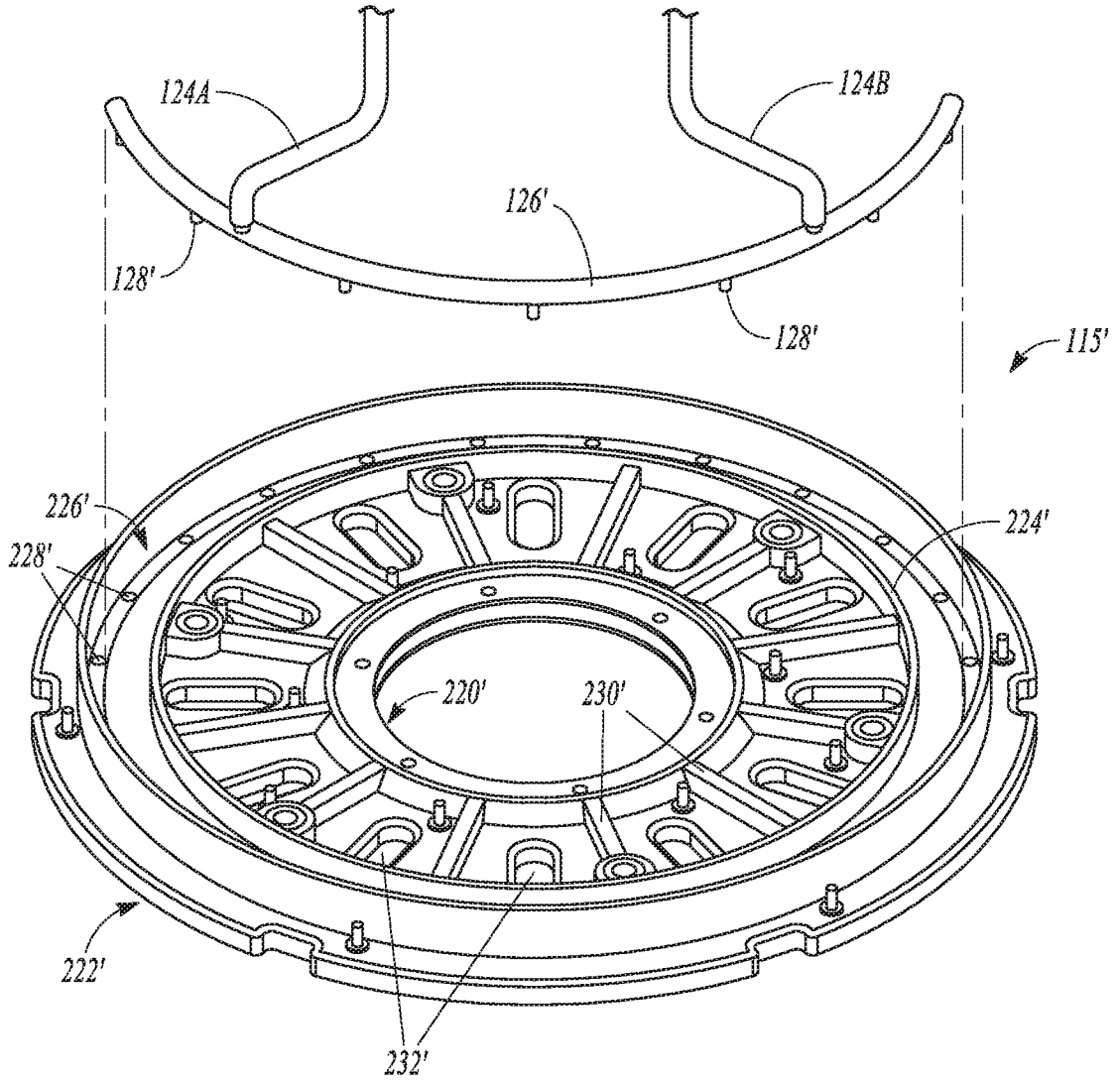
FIG. 15 is a perspective view of a driver located above the cleaning element driver of FIG. 14 showing orifices that receive cleaning fluid from the arcuate cleaning fluid manifold.
Figure 16:
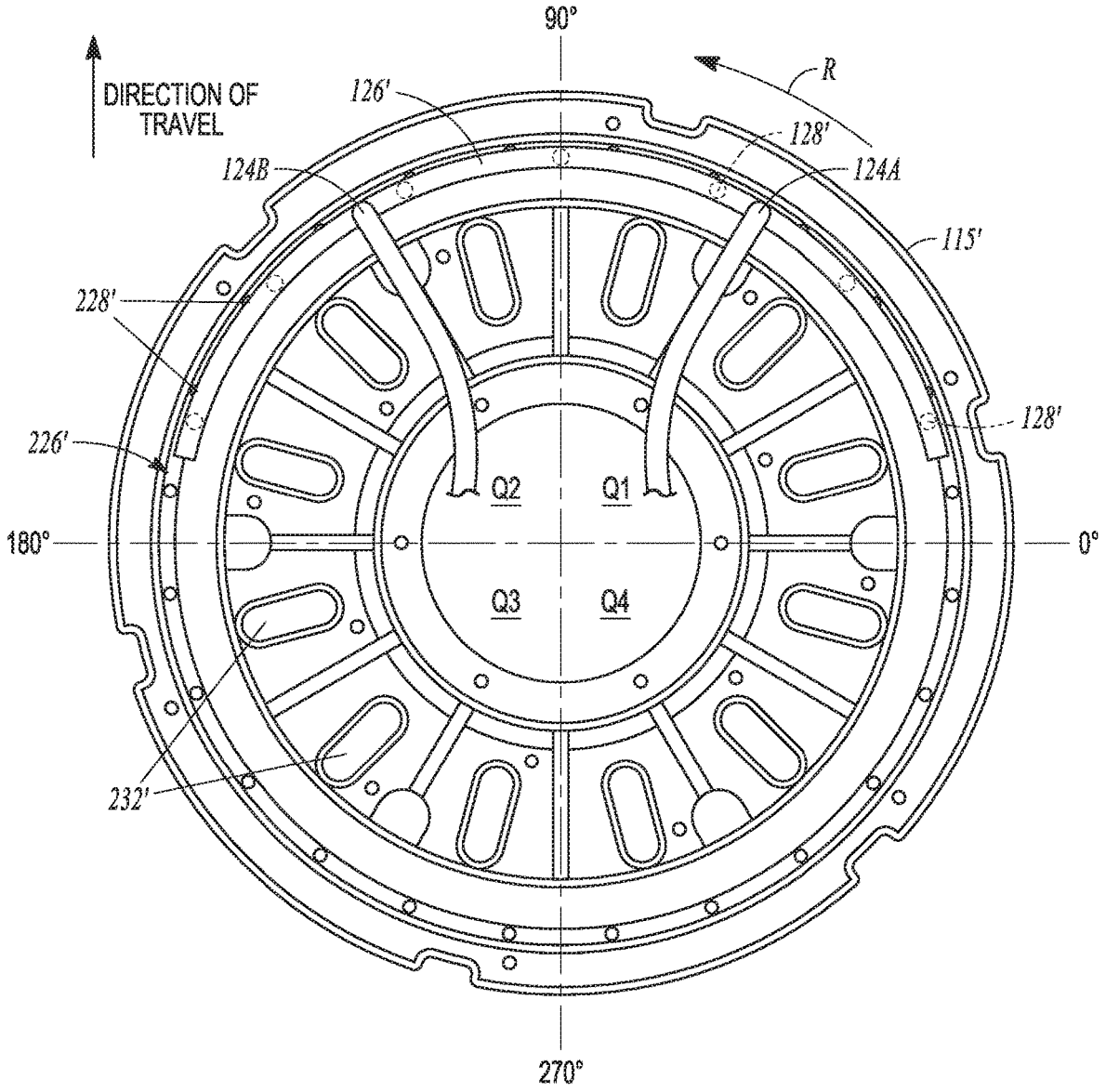
FIG. 16 is a diagram illustrating a top view of the driver of FIG. 15 showing an example location for the arcuate cleaning fluid manifold with the motor mounting plate removed to show two feed tubes and the presence of multiple cleaning fluid orifices in the arcuate manifold.
Figure 21:
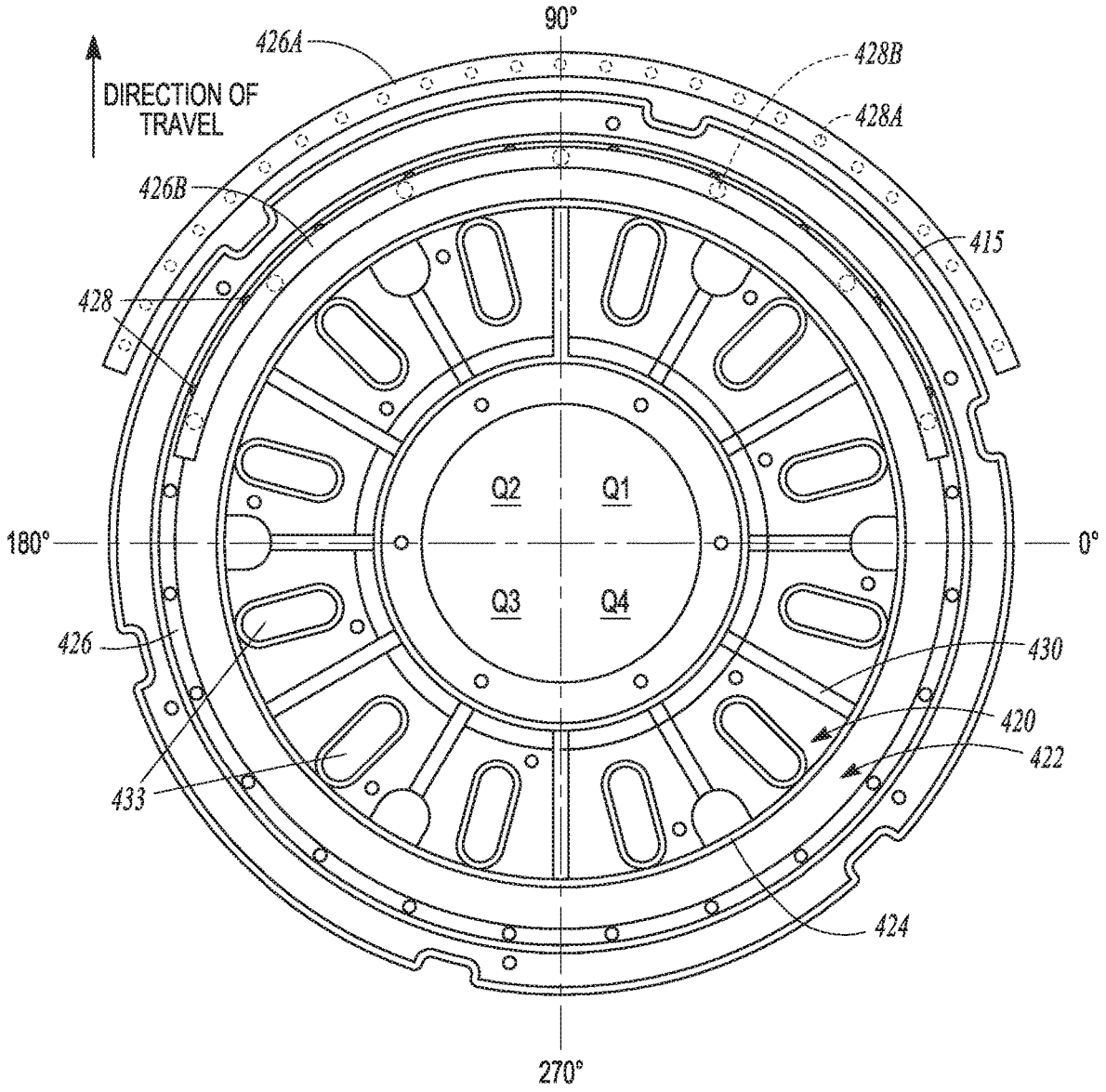
FIG. 21 is a diagram illustrating a top view of a driver from the cleaning head assembly of FIG. 20 showing example locations for the interior-mounted and exterior-mounted arcuate cleaning fluid manifolds and the presence of multiple cleaning fluid orifices in the arcuate manifolds.
Figure 22:
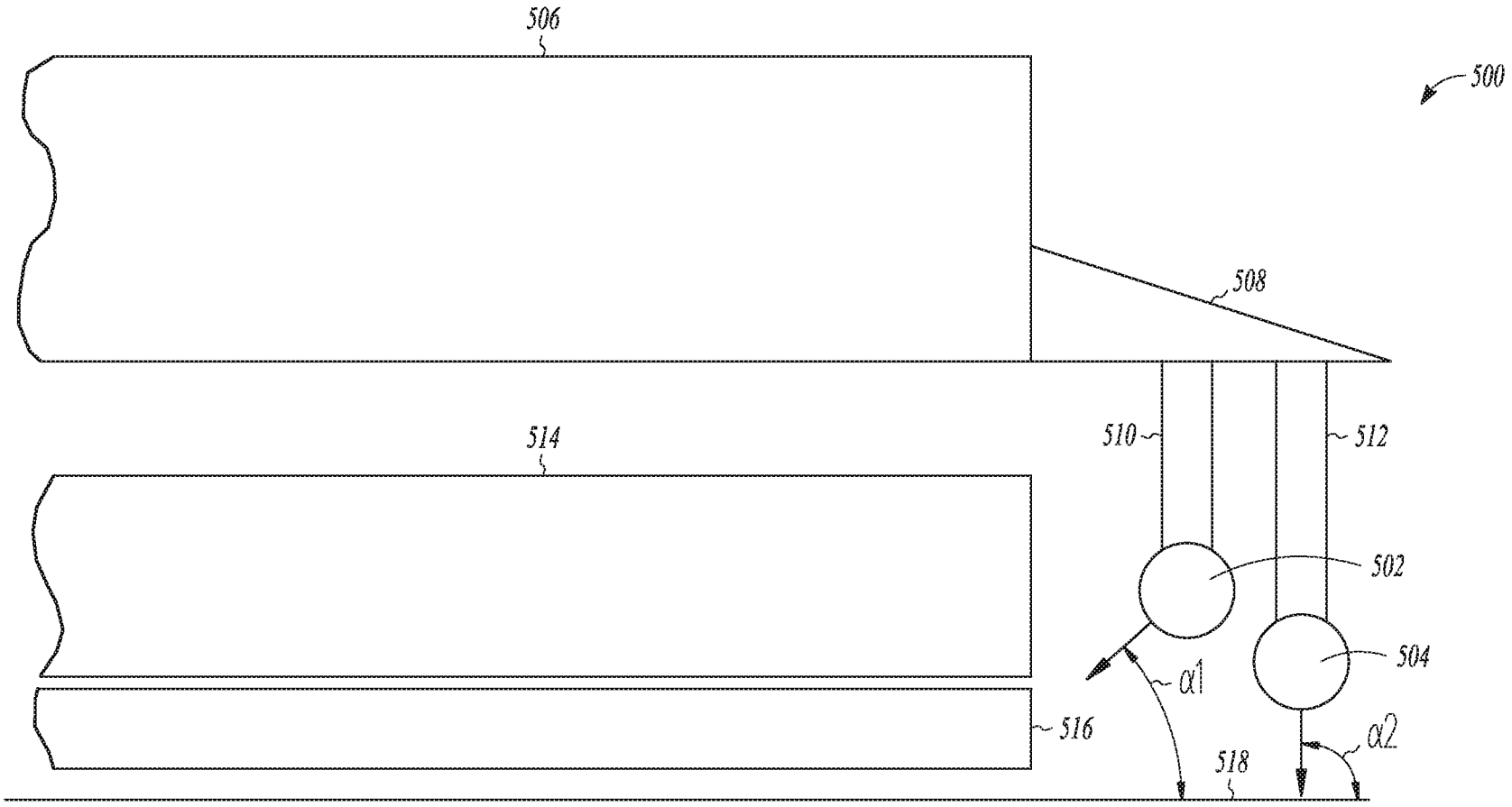
FIG. 22 is a diagram illustrating a cleaning head assembly having two arcuate cleaning fluid manifolds mounted in front of a housing with each arcuate cleaning fluid manifold having a different spray angle.

The foregoing description sets forth an example of a random orbit disc scrubber 100 that can be configured to dispense cleaning fluid using a single manifold located in front of cleaning head assembly 106, and is thus mounted to the exterior of the housing 109. However, in other examples, cleaning fluid can be dispensed one top of the cleaning element 112, such as by being mounted to the interior of the housing 109, as described with reference to FIGS. 14-16. at more than one dispensing location. FIGS. 14-16 describe an example of a random orbit disc scrubber 100 having a cleaning head assembly 106' with manifold assembly 107'. Particularly, the cleaning head assembly 106' is generally similar to the cleaning head assembly 106 described above with reference to FIGS. 2-13, with the exception of the mounting location. FIGS. 14-15 illustrate the difference in mounting location. FIGS. 21 and 22 show an embodiment having two manifold assemblies similar to the combination of manifold assembly 107 and manifold assembly 107'.

FIG. 14 is a front perspective view of the cleaning head assembly 106' isolated from the remainder of the scrubber 100 to better show the components of the cleaning head assembly 106'. Compared to the cleaning head assembly 106, the cleaning head assembly 106' includes, for example, a modified motor mounting plate 146', a modified driver 115', and a modified solution dispensing system including a manifold housing 126' fluidly coupled to the fluid conduits 124A and 124B, respectively, and having nozzles 128'. Thus, as will be discussed in further detail below, solution can be dispensed adjacent to a front right portion and a front left portion of the driver 115'.

FIG. 15 is a perspective view of the driver 115' illustrating various design features of the driver 115'. As illustrated in FIG. 15, the driver 115' includes an inner region 220' and an outer region 222' separated by a circumferential ridge 224'. Unlike the driver 115 which included a trough 226 defined in the inner region 220, the driver 115' can include a trough 226' defined the outer region 222'. The trough 226' can have having a plurality of apertures 228' for dispensing the cleaning fluid to the cleaning element 112. Particularly, cleaning fluid can be delivered through the fluid conduits 124A and 124B and the manifold housing 126' to the trough 226' where it can be funneled through the apertures 228' and onto the rotating cleaning element 112.

In the present example, the driver 115' includes a plurality of apertures 228' that can receive fluid from the nozzles 128'. The drivers 115 and 115' can include any number of apertures 228 and 228', respectively, without departing from the spirit and scope of the application.

As illustrated in FIG. 15, the inner region 220' of the driver 115' includes a plurality of circumferentially spaced ribs 230' that are structured to provide rigidity to the driver 115'. As further illustrated in FIG. 15, the inner region 220' can include a plurality of suitably sized slots 232' for reducing the weight of the driver 115'.

FIG. 16 is a diagram illustrating a top view of the driver 115' showing the dispensing locations of the cleaning fluid from the manifold housing 126' and nozzles 128'. Once again, it is assumed that the direction of travel is oriented toward the top of the page as shown, and the direction of rotation R of the driver 115' is counterclockwise.

In the example of FIG. 16, the first or front right quadrant Q1 as viewed from the top of the driver 115' when the driver 115' is rotating in the counterclockwise direction can include three nozzles 128'. Further, the second or front left quadrant Q2 can include three nozzles 128'. Also, another nozzle 128' can be located between the front right quadrant Q1 and the froth left quadrant Q2. Compared to the dispensing location of the solution dispenser 126 in FIG. 13, the dispensing locations of the solution dispenser 126' is positioned in the outer region 222' within the perimeter of the driver 115' rather than being out in front of the driver 115'. It has been found that dispensing the cleaning fluid from multiple locations in an outer region of the driver can also result in a fluid distribution that is substantially uniform across the surface area of the cleaning element 112 without expelling any significant amount of solution outside of the cleaning head assembly 106'.

Because the cleaning fluid is distributed in both the first or front right quadrant Q1 and the second or front left quadrant Q2 in the foregoing example, reversing the direction of rotation R of the driver 115' will have no significant effect on the fluid distribution to the cleaning element 112. The manifold housing 126' can extend across a particular width of the cleaning path or a particular portion of the circumference of the driver 115' as described above with reference to the manifold housing 126 and the driver 115 in FIG. 13.

Figure 17:
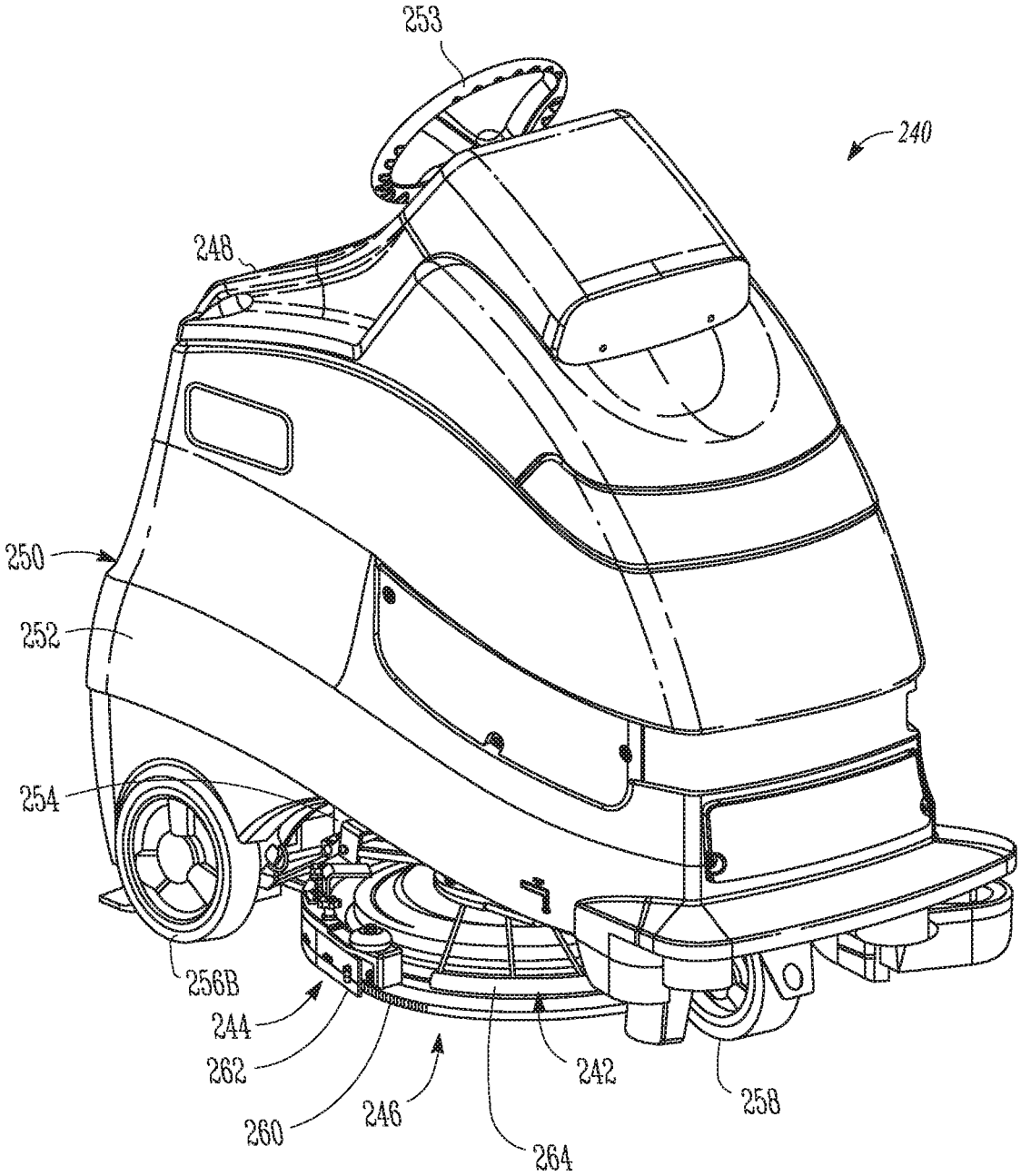
FIG. 17 is a perspective view of a stand-on random orbit disc scrubber having an arcuate cleaning fluid manifold and a squeegee assembly mounted to a cleaning head assembly.

FIG. 17 is a perspective view of a stand-on random orbit disc scrubber, or cleaning machine, 240 having an arcuate cleaning fluid manifold 242 and a squeegee assembly 244 mounted to a cleaning head assembly 246. The machine 240 can include a control panel 248, a passenger platform compartment 250 in main cowling 252, and a chassis 254 to which wheels 256A, 256B and 258 can be connected. The chassis 254 can support various cleaning devices, such as the cleaning head assembly 246, the squeegee assembly 244, and the arcuate cleaning fluid manifold 242. The chassis 254 can be connected to or form part of the platform compartment 250.

The floor cleaning machine 240 can be configured to clean, treat, scrub, or polish a floor surface, or perform other similar actions using, for example, the scrubber 260 of the cleaning head assembly 246 and the squeegee 262 of the squeegee assembly 244. The cleaning head assembly 246 and the squeegee assembly 244 can be mounted to a carriage 264. An operator can stand in the platform compartment 250 within main cowling 252 and control the machine 240 using the control panel 248 and the steering wheel 253.

The embodiment of FIG. 17 can include the various cleaning fluid manifolds described herein. The features described with reference to FIG. 17 can be applied to any type of floor cleaning equipment, such as scrubbers, sweepers, and extractors, whether stand-on or walk-behind.

The platform compartment 240 can include a platform to support the weight of an operator in a standing position. In other examples, the machine 240 can be configured to accommodate a sitting operator. The machine 240 can be of a three-wheel design having two wheels 256A (not visible in FIG. 17.) and 256B generally behind the center of gravity of the machine 240 and one wheel 258 in front of the center of gravity. In an example, the platform compartment 250 can be located behind the center of gravity. The front wheel 258 can be both a steered wheel and a driven wheel. In an example, the rear wheels 256A and 256B are not driven.

The machine 240 can be electrically operated and can include a battery for powering the various components of the machine 240. Motors within the machine 240 (not shown) or the steering wheel 253 can be used to the turn wheel 258. Additionally, the wheel 258 can be connected to a prime mover, such as an electric motor that provides propulsive force to the machine 240.

The cleaning head assembly 246 can be configured to provide a cleaning action, such rotary disc, orbital or cylindrical cleaning, to the scrubber 250 to clean a floor surface. Fluid from a liquid cleaning system disposed within the main cowling 252 can be dispensed by the machine 240 to facilitate scrubbing performed by the scrubber 260. A liquid system can include a liquid storage tank, a pump system, and the cleaning fluid manifold 242. The squeegee 262 can be used to corral or wipe dirty fluid behind the scrubber 260 and can be connected to a recovery system having a tank (e.g., tank 24 of FIG. 1) disposed within the main cowling 252. A recovery system can include a suction tube (e.g., conduit 32 of FIG. 1), a suction motor (e.g., motor 38 of FIG. 1), and a storage tank (e.g., tank 24 of FIG. 1).

The carriage 264 can be configured to couple to the chassis 254 or the cleaning head assembly 246. The carriage 264 can carry the cleaning fluid manifold 242 and the squeegee assembly 244. In various examples, the carriage 264 can be configured to rotate about a pivot point to position the cleaning fluid manifold 242 and the squeegee assembly 244 at different positions about the perimeter, or circumference, of the scrubber 260. In embodiments, the carriage 264 can be driven by a motor that positions the cleaning fluid manifold 242 and the squeegee assembly 244 at desired positions while the machine 240 is performing turning procedures. In other embodiments, the carriage 264 can be configured to freely rotate about the perimeter of the scrubber 260 such that contact between the floor surface and the squeegee 262 determine the position of the carriage 264 as the machine 240 turns. As such, the cleaning fluid manifold 242 can be better positioned in the front of the cleaning head assembly 246 to dispense cleaning fluid in front of scrubber 260, and the squeegee assembly 244 can be better positioned in the rear of the cleaning head assembly 246 to recover cleaning fluid behind scrubber 260.

Figure 18A:
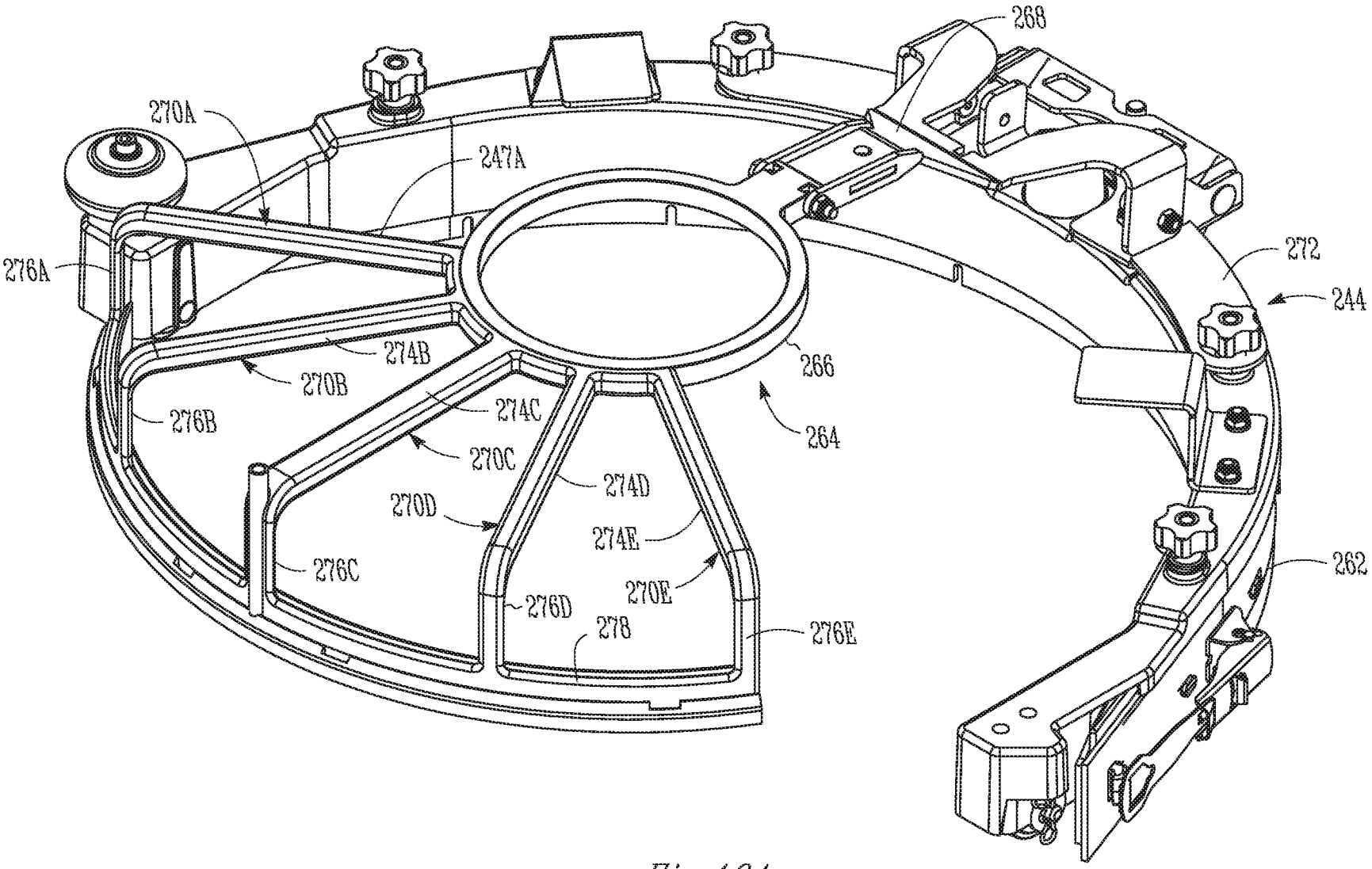
FIGS. 18A and 18B are perspective and exploded views, respectively, of the rotatable carriage of FIG. 17 showing the arcuate cleaning fluid manifold and the squeegee assembly.
Figure 18B:
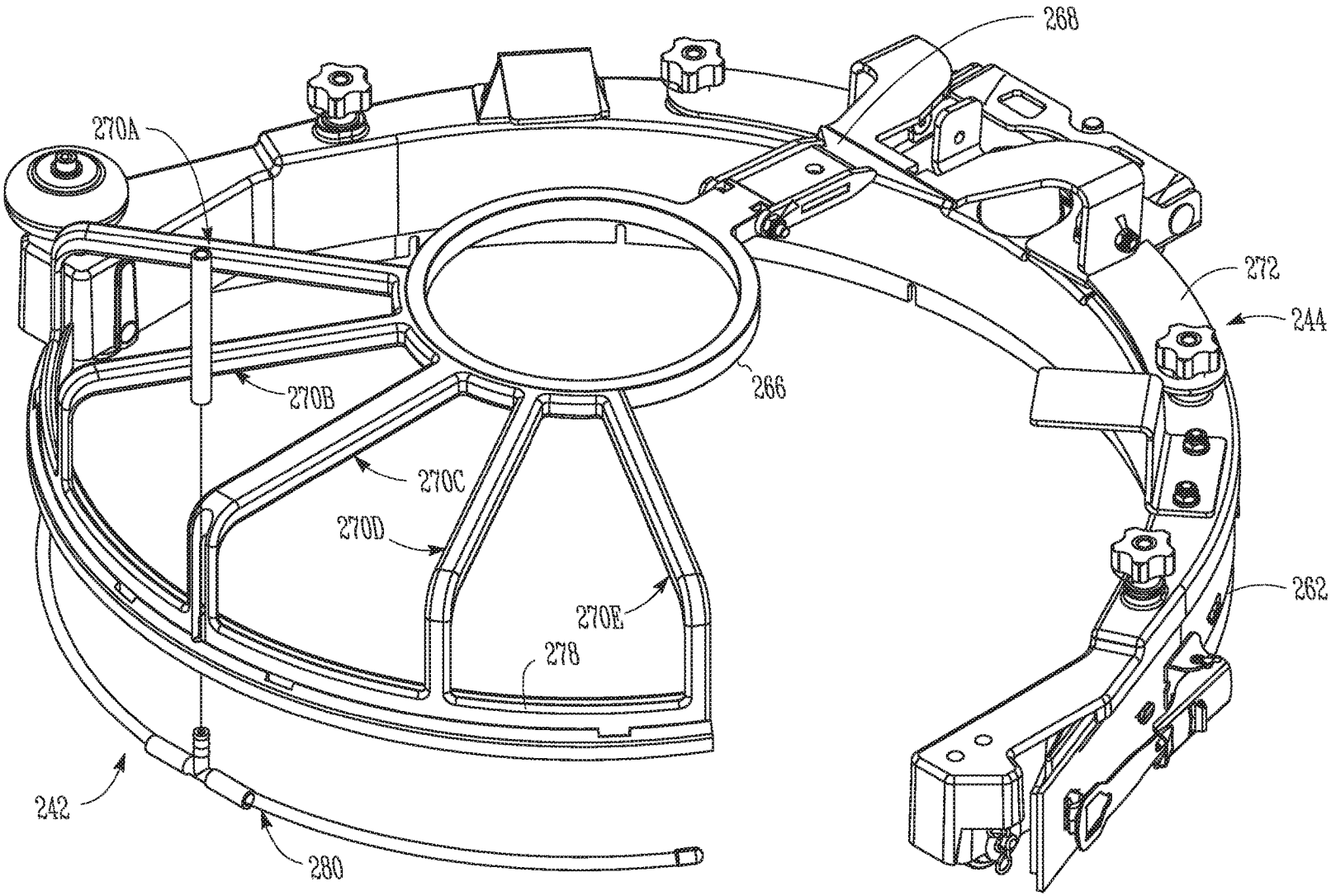

FIGS. 18A and 18B are perspective and exploded views of the cleaning head assembly 246 of FIG. 17 showing the rotatable carriage 264 for the arcuate cleaning fluid manifold 242 and the squeegee assembly 244. The rotatable carriage 264 can include a mount 266, an extension 268 for connecting to the squeegee assembly 244, and brackets 270A-270E for connecting to the manifold 242.

The squeegee assembly 244 can comprise any suitable system that can be connected to the mount 266 and that can support the squeegee 262. The squeegee assembly 244 can include a squeegee bracket 272 to support the squeegee 262, which can comprise a rubber blade, and to couple to the extension 268. The bracket 272 can comprise a rigid arcuate or semi-circular body to wrap around the perimeter of the mount 266.

The manifold 242 can be configured according to any of the manifolds described herein. The brackets 270A-270E can have a variety of shapes to support the manifold 242 from the mount 266. In an example, the brackets 270A-270E can include horizontal projections 274A-274E and vertical projections 276A-276E. The vertical projections 276 can connect to a manifold channel body 278. The horizontal projections 274A-274E can extend straight over the scrubber 260 and the vertical projections 276A-276E can extend down from the horizontal projections 274A-274E to bring the manifold channel body 278 past or alongside the driver for the scrubber 260 and closer to a floor surface. The brackets 270A-270E can extend from the mount 266 in different radial directions to provide support for the arcuate cleaning fluid manifold 242 along the length of the manifold 242. The manifold channel body 278 can comprise a housing for supporting a manifold tube 280. As discussed below with reference to FIGS. 23-25, the manifold 242 can be configured to provide an arcuate housing that receives a separate arcuate manifold reservoir to facilitate assembly of the manifold reservoir to the cleaning head assembly. For example, manifold channel body 278 can include a channel into which manifold tube 280 can be press-fit or snap-fit.

The mount 266 can comprise a coupling point for linking the rotatable carriage 264 to the machine 240. The mount 266 can comprise a ring that connects to the cleaning head assembly 246 or the chassis 254. For example, the mount 266 can coupled around a circular body against which it can rotate, such as a motor housing or a mating ring of smaller diameter. In an example, the mount 266 can couple to the cleaning head assembly 246 centrally around a drive shaft that rotates or orbits the scrubber 260. Thus, in an example, the channel body 278, squeegee bracket 272, mount 266 and scrubber 260 can be mounted around a common central axis.

The rotatable carriage 264 provides a common mounting point for both the manifold 242 and the squeegee assembly 244 to pivot about the scrubber 260. The rotatable carriage 264 can be mounted to freely rotate about the scrubber 260. That is, the rotatable carriage 264 can be free to pivot about the scrubber 260 under its own power through contact of the squeegee 262 with the floor surface. Thus, as the machine 240 turns along the cleaning path, the squeegee 262 drags along the floor surface through friction and the rotatable carriage 264 changes its rotational position relative to the scrubber 260 as the machine 240 moves relative to that portion of the floor surface. In other embodiments, the rotatable carriage 264 can be powered, such as with an electric motor, to actively change rotational position, such as based on the steering of the machine 240.

Figure 19A:
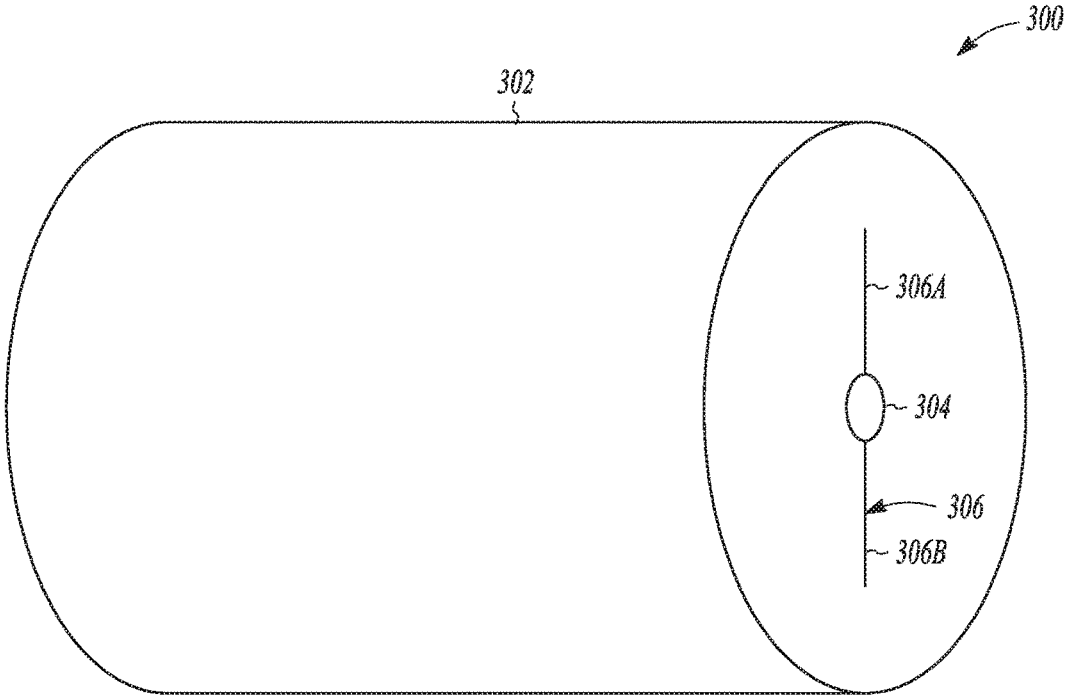
FIGS. 19A and 19B are perspective views of a variable flow cleaning fluid nozzle for use with the manifolds of the present application in a closed, low-flow state and an open, high-flow state, respectively.
Figure 19B:
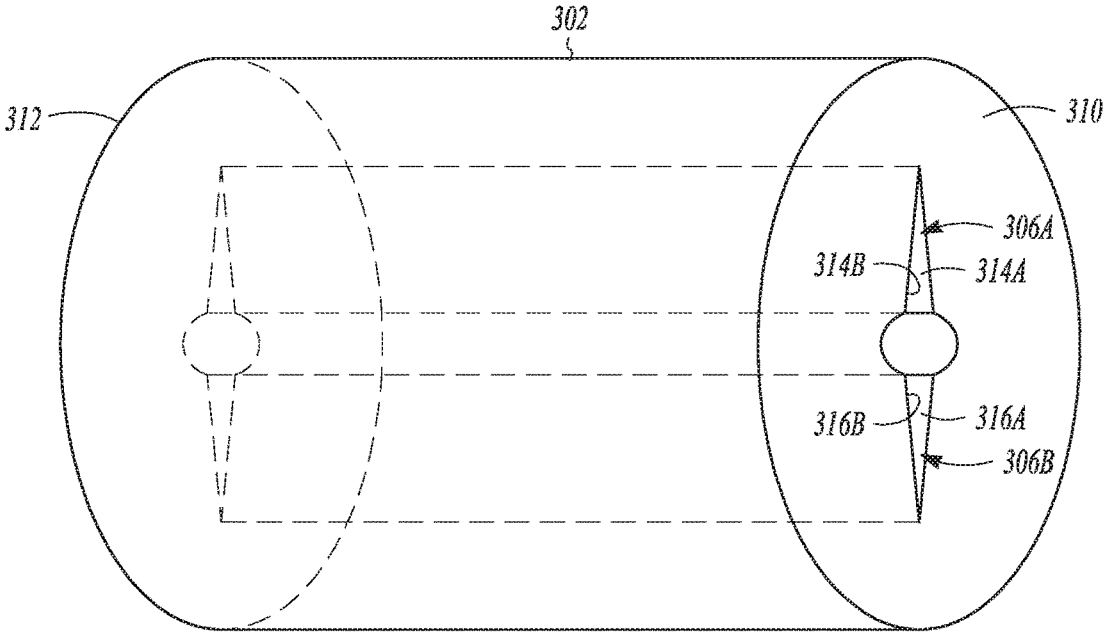

FIGS. 19A-19B are perspective views of a variable flow cleaning fluid nozzle 300 for use with the manifolds of the present application in a closed, low-flow state and an open, high-flow state, respectively.

The nozzle 300 is shown having a body 302, an orifice 304 and a split 306 having a first end 306A and a second end 306B. The body 302 can include a cylindrical surface 308, a first end surface 310 and a second end surface 312. The orifice 304 can extend from the first end surface 310 to the second end surface 320. Likewise, the first slit end 306A and second slit end 306B can extend from the first end surface 310 to the second end surface 320.

As can be seen in FIG. 19B, the first slit end 306A can include first opposing slit surfaces 314A and 314B, and the second slit end 306B can include second opposing slit surfaces 316A and 316B. The body 302 of the nozzle 300 can be made of a flexible material, such as an elastomer, so as to stretch or bend from the shape of FIG. 19A to the shape of FIG. 19B.

As shown in FIG. 19A, the nozzle 300 can be used to dispense a first volume of cleaning fluid by providing a first total volume between surfaces of the orifice 304 and the slit 306. In FIG. 19A, first opposing slit surfaces 314A and 314B and second opposing slit surfaces 316A and 316B touch each other, respectively, such that the slit 306 forms a passage having a volume of zero or nearly zero. In the example of FIGS. 19A and 19B, the orifice 304 is circular such that the orifice 304 has a volume directly proportional to the circumference of the orifice 304. As such, when cleaning fluid is pumped, or otherwise passed through, the nozzle 330, the cleaning fluid can only pass through the orifice 304. For example, the cleaning or scrubbing machine to which the nozzle 300 is attached can be configured to pump cleaning fluid at a first pressure that is insufficient to flex the body 302. However, the cleaning or scrubbing machine to which the nozzle 300 is attached can be configured to pump cleaning fluid at a second pressure, greater than the first pressure, that is sufficient to flex the body 302 to push first opposing slit surfaces 314A and 314B and second opposing slit surfaces 316A and 316B away from each other, respectively, as shown in FIG. 19B.

As shown in FIG. 19B, first opposing slit surfaces 314A and 314B and second opposing slit surfaces 316A and 316B become spaced from each other, respectively, to form triangular-shaped passages having volumes sufficiently greater that in the closed position to permit cleaning fluid to freely flow through the body 302. Thus, when cleaning fluid is pumped, or otherwise passed through, the nozzle 330, the cleaning fluid can pass through the expanded space between surfaces 304A and 304B of the orifice 304 and the spaces between first opposing slit surfaces 314A and 314B and second opposing slit surfaces 316A and 316B, respectively. Thus, under higher pressures, pressures sufficient to flex or bend the material of the body 302, a greater volume of cleaning fluid can be dispensed from the nozzle 300.

As described above, the nozzle 300 comprises a variable flow nozzle for cleaning fluid that can be used to apply two different volumes of cleaning fluid for two different operating modes of a cleaning or scrubbing machine. For example, in a first, low-flow mode, the cleaning machine can be configured to only dispense fluid between the surfaces of the orifice 304 in situations where the floor surface the cleaning machine is being used on is only slightly dirty. However, in a second, high-flow mode, the cleaning machine can be configured to dispense fluid between the surfaces of the orifice 304 and the surfaces of slit ends 306A and 306B in situations where the floor surface the cleaning machine is being used is very dirty. Operator judgment can be used to determine slightly dirty and very dirty conditions. Additionally, the low-flow and high-flow modes can be used to clean different types of floor surfaces, such as hard surfaces and carpeted surfaces, respectively. In addition to providing two different cleaning fluid flow modes for operation of the cleaning machine, flexible nozzles are also less susceptible to clogging, as debris and other matter can work its way out of the nozzle 300 by generating small, localized deflections of the walls 304A and 304B of the orifice 304.

Figure 20:
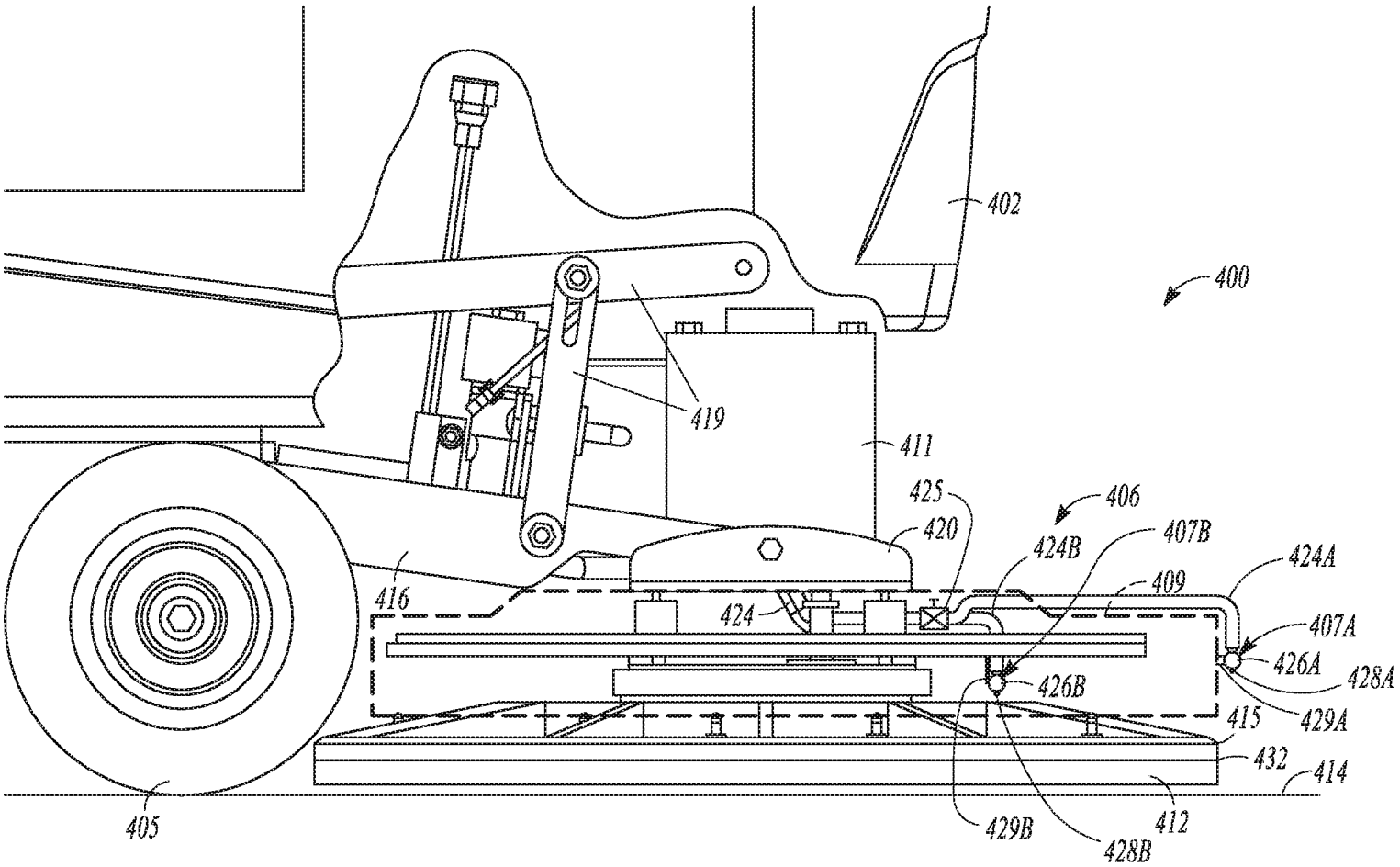
FIG. 20 is a partial side view of a cleaning head assembly for a random orbit disc scrubber having an interior-mounted arcuate cleaning fluid manifold and an exterior-mounted arcuate cleaning fluid manifold.

FIG. 20 is a partial side view of a scrubber machine 400 for a random orbit disc scrubber having a main body 402. In FIG. 20, a portion of the main body 402 is removed to illustrate various components of a cleaning head assembly 406 and its attachment to the main body 402 and an interior-mounted arcuate cleaning fluid manifold assembly 407A and the exterior-mounted arcuate cleaning fluid manifold assembly 407B. The housing 409 of the cleaning head assembly 406 is also shown in broken lines to allow visualization of the cleaning head assembly components. The cleaning head assembly 406 can include a motor 411 that imparts both rotational and orbital movement on a suitable cleaning element 412 that can be structured for contact with a floor surface 414. Particularly, the rotational and orbital movement can be transferred to the cleaning element 412 via a rotatable and orbitable driver 415 that can be driven by the motor 411 as will be discussed in further detail to follow. The random orbit disc scrubber 400 can include a right lift arm 416 and a left lift arm 418 (not visible in FIG. 20) that pivotally engage a right lift bracket 420 and a left lift bracket 422 (not visible in FIG. 20).

As illustrated in FIG. 20, the manifold assemblies 407A and 407B can include a fluid conduit 424, and a control valve 425. The assemblies 407A and 407B can include manifold housings 426A and 426B, nozzles 428A and 428B, and mounting brackets 429A and 429B. The fluid conduit 424 can run from the solution tank (not shown) to the valve 425. From the valve 425, the fluid conduits 425A and 425B can be run to the manifold housings 426A and 426B, respectively. The valve 425 can be operated at a control panel, such as control panel 248 of FIG. 17. The valve 425 can be used to gravity feed manifold housings 426A and 426B or to permit pressurized cleaning fluid to enter manifold housings 426A and 426B.

The manifold housing 426A can be positioned out front of the cleaning head assembly 406 for controllably dispensing the cleaning fluid onto the floor surface 414. In an example, the cleaning fluid can be pumped from the solution tank through the fluid conduits 424 and 425A to the manifold housing 426A such that the cleaning fluid sprays through the nozzles 428A at a desired pressure. The manifold housing 426A can include multiple nozzles 428A that permit cleaning fluid to spray onto floor 414 in multiple locations in front of the rotating cleaning element 412.

The manifold housing 426B can be positioned underneath the driver 415 inside the cleaning head assembly 406 for controllably dispensing the cleaning fluid onto the cleaning element 412. In an example, the cleaning fluid can be pumped from the solution tank through the fluid conduits 424 and 425B to the manifold housing 426B such that the cleaning fluid sprays through the nozzles 428B at a desired pressure. The manifold housing 426B can include multiple nozzles 428B that permit cleaning fluid to spray onto floor 414 in multiple locations on top of the rotating cleaning element 412.

In various embodiments, the nozzles 428A and 428B can comprise variable flow nozzles, such as those described with reference to FIGS. 20A and 20B. In various examples, the manifold housings 426A and 426B can include simple through-bores (as discussed with reference to FIG. 13) instead of the nozzles 428A and 428B to permit the cleaning fluid to pass through the manifold housings 426A and 426B, respectively. In examples, the nozzles 428A and 428B or the through-bores can be oriented to dispense cleaning fluid in a direction straight down to the floor surface 414 or backward to the cleaning element 412.

FIG. 21 is a diagram illustrating a top view of the driver 415 from the cleaning head assembly 416 of FIG. 20 showing example locations for the interior-mounted cleaning fluid manifold housing 426B and the exterior-mounted arcuate cleaning fluid manifold 426A and the presence of multiple cleaning fluid orifices 428B and 428A, respectively, in each arcuate manifold.

As illustrated in FIG. 21, the driver 415 can include an inner region 420 and an outer region 422 separated by a circumferential ridge 424. The inner region 420 can define a trough 426 having a plurality of apertures 428. The inner region 420 of the driver 415 includes a plurality of circumferentially spaced ribs 430 that are structured to provide rigidity to the driver 415. As further illustrated in FIG. 21, the outer region 422 can include a plurality of suitably sized slots 434 for reducing the weight of the driver 415. The driver 415 can be divided into four quadrants, Q1, Q2, Q3 and Q4, as discussed above. The manifold housings 426A and 426B can extend across a particular width of the cleaning path or a particular portion of the circumference of the driver 415 as described above with reference to the manifold housing 126 and the driver 115 in FIG. 13.

As will be appreciated by those skilled in the art based on the foregoing, the rotational and orbital movement of the cleaning element 412 can entrap the cleaning fluid inside the cleaning element by its small and fast orbiting action and constant velocity directional changes. The manifold assemblies 407A and 407B can strategically place cleaning fluid on top or in front of the cleaning element 412 to maximize use of all the surface area of the cleaning element 412, thereby improving the overall efficiency of the scrubber machine 400. Because the cleaning fluid is entrapped within the cleaning element 412, approximately ½ to ¼ the amount of cleaning fluid, or even less, can be required as compared to a traditional rotary disc scrubber for the same amount of cleaning. The combined rotational and orbital movement of the cleaning element 412 can also produce a more uniform scrub pattern without the "swirls" that are often produced by traditional rotary disc scrubbers.

FIG. 22 is a diagram illustrating a cleaning head assembly 500 having a first arcuate cleaning fluid manifold 502 and a second arcuate cleaning fluid manifold 504 mounted in front of a housing 506 having first spray angle at and second spray angle $\alpha_2$, respectively. The cleaning head assembly 500 can include a bracket 508 that can couple the manifolds 502 and 504 to the housing 506 via extensions 510 and 512, respectively. The driver 514 and the cleaning element 516 are shown disposed below the housing 506 and above the floor surface 518.

The driver 514 and the cleaning element 516 can comprise any of the components described herein, such a brush block and brush or a pad holder and pad, respectively. The driver 514 can be configured to rotate or orbit the cleaning element 516 against the floor surface 518 as is described herein, for example. The housing 506 can support elements of the cleaning head assembly 500, such as a motor for the driver 514 and the bracket 508.

The manifolds 502 and 504 can be configured to distribute a cleaning fluid to the floor surface 518 and the cleaning element 516. The cleaning head assembly 500 can be provided with two cleaning fluid manifolds to provide a variety of cleaning fluid options for cleaning the floor surface 518. For example, the manifolds 502 and 504 can provide different cleaning fluids, can provide different pressure cleaning fluids, can provide cleaning fluid at different locations on the floor surface 518, at different locations on the floor surface 518 and the cleaning element 516, at different heights above the floor surface 518, and various combinations thereof.

In the illustrated exemplary embodiment, the extension 512 can be connected to the bracket 508 further in front of the extension 510, while the extension 512 can be closer to the floor surface 518 than the extension 510. As such, the manifold 502 can be positioned closer to the cleaning element 516 and the manifold 504 can be positioned closer to the floor surface 518. The manifold 502 can be configured to dispense or spray cleaning fluid directly at or onto the cleaning element 516 and the manifold 504 can be configured to dispense or spray cleaning fluid directly onto the floor surface 518.

The extension 510 can have a length so that the manifold 502 can be positioned close to the cleaning element 516 to apply cleaning fluid into the cleaning element 516, which can result in cleaning fluid being applied where it is most effective, and can help reduce splashing. The manifold 502 can include spray orifices or spray nozzles that are configured to dispense cleaning fluid at an angle relative to the floor surface 518 such that angle $\alpha_2$ is approximately forty-five degrees.

The extension 512 can have a length so that the manifold 504 can be positioned close to the floor surface 518 to reduce splashing of cleaning fluid contacting the floor surface 518. The manifold 504 can include spray orifices or spray nozzles that are configured to dispense cleaning fluid straight into or normal to the floor surface 518 such that angle $\alpha_2$ is approximately ninety degrees.

In other embodiments, the manifold 502 can be configured to dispense cleaning fluid in a range from approximately parallel to the floor surface 518 (e.g., horizontal to be directed straight back at a cleaning element) to approximately perpendicular to the floor surface 518 (e.g., longitudinal to be directed straight down at a floor surface). The manifold 504 can also be configured in such a range in different embodiments.

Figure 23:
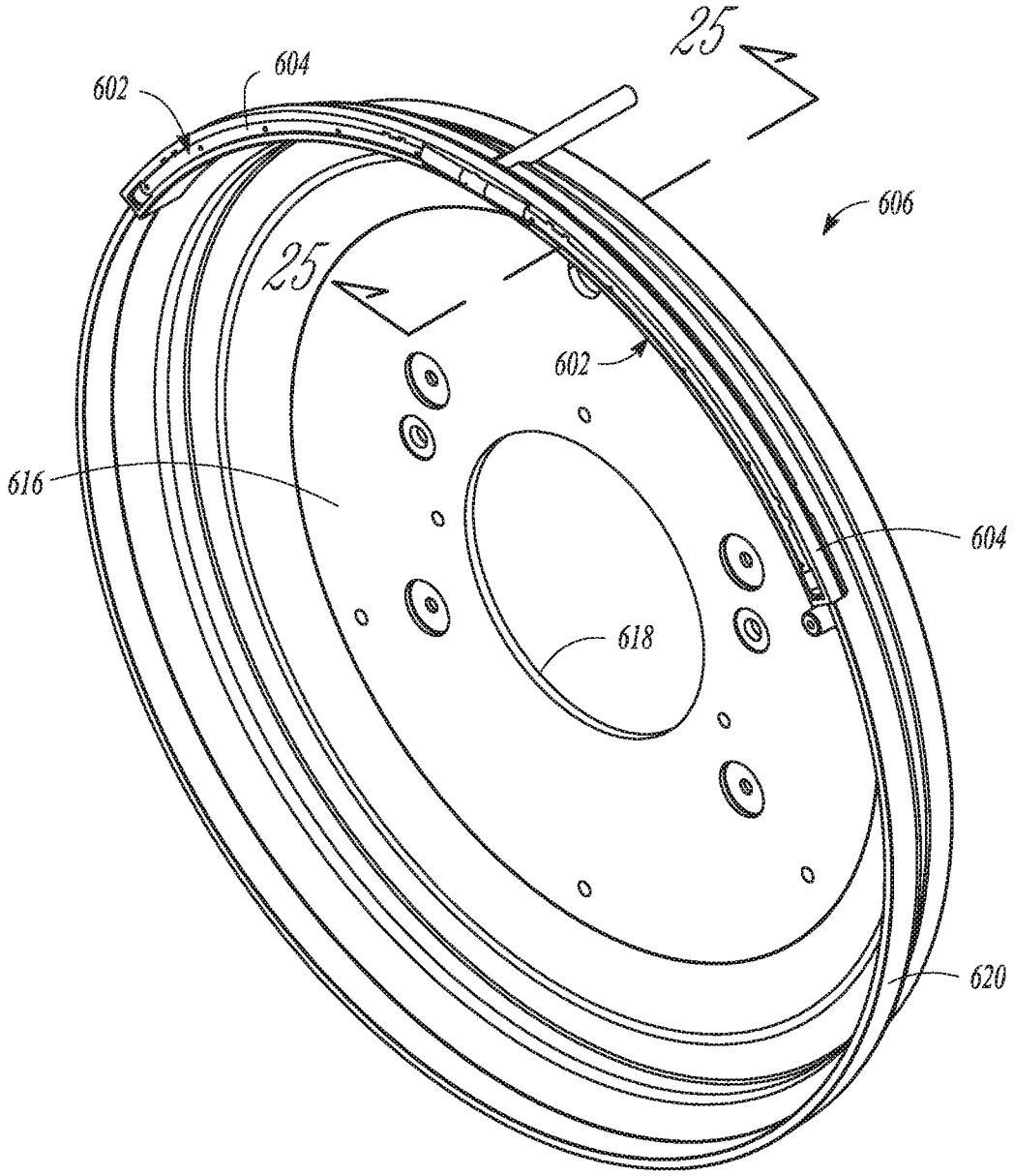
FIG. 23 is a perspective view of a bottom of a housing for a cleaning head assembly wherein an arcuate cleaning fluid manifold is disposed within a downward facing channel of the housing.
Figure 24:
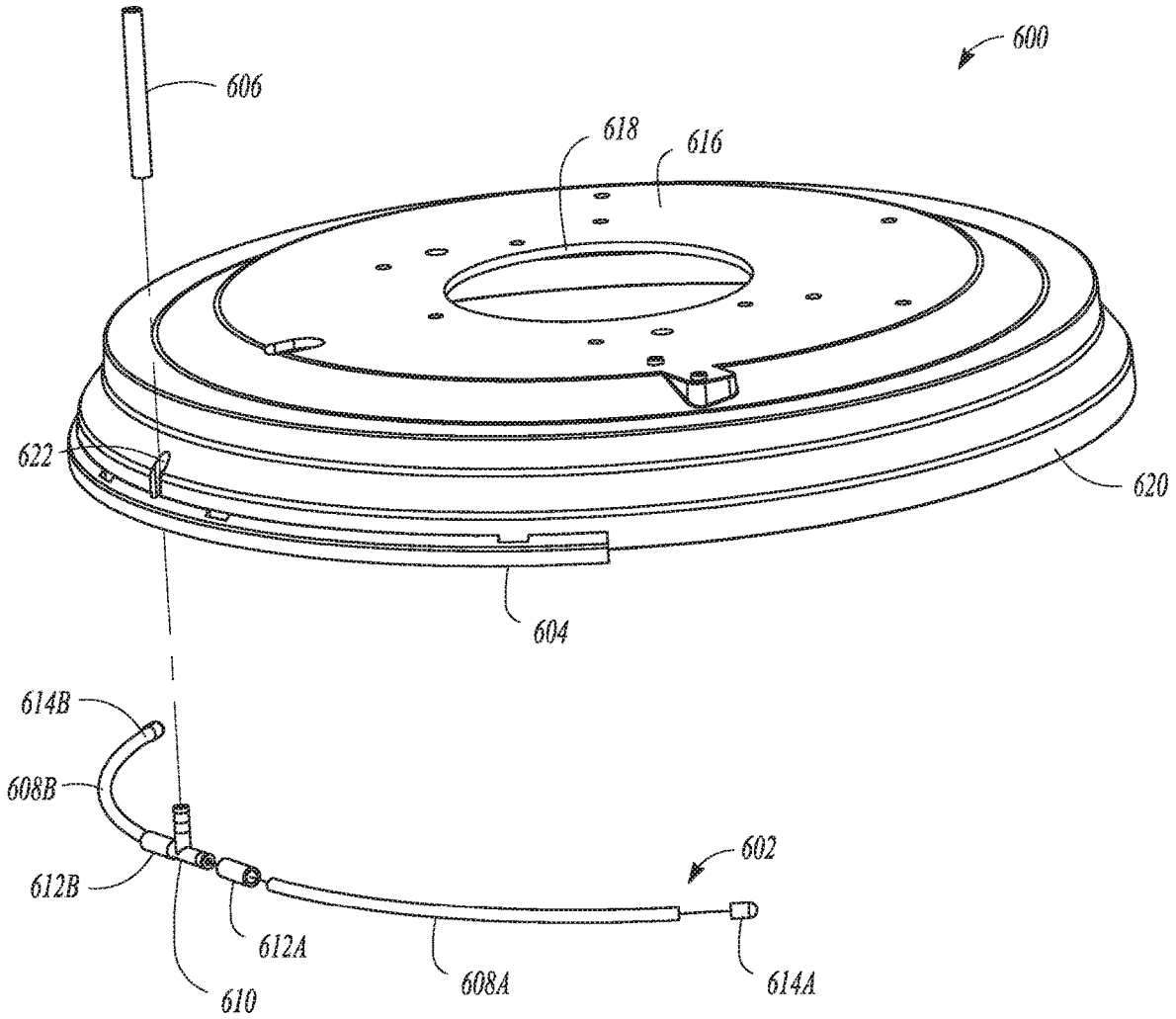
FIG. 24 is an exploded perspective view of a top of the housing of FIG. 23 showing the arcuate cleaning fluid manifold exploded from the downward facing channel and components of the arcuate cleaning fluid manifold exploded from each other.

FIG. 23 is a perspective view of a bottom of a housing 600 for a cleaning head assembly wherein an arcuate cleaning fluid manifold 602 can be disposed within a downward facing channel body 604 of the housing 600. FIG. 24 is an exploded perspective view of a top of the housing 600 of FIG. 23 showing the arcuate cleaning fluid manifold 602 exploded from the downward facing channel body 604 and components of the arcuate cleaning fluid manifold 602 exploded from each other. As can be seen in FIG. 24, the manifold 602 can include a pipe 606, a first tube 608A, a second tube 608B, a tube coupler 610, a first joint coupler 612A, a second joint coupler 612B, a first end cap 614A and a second end cap 614B.

The housing 600 can comprise a disk-like body 616 having features, such as openings or sockets, for mounting a motor and a central opening 618 through which drive components of a cleaning head assembly, such as a shaft or cam, can extend through. The body 616 can provide a rigid support for the motor that extends out over a cleaning element. The housing 600 can include sidewalls 620 that extend outward from the body 616 to at least partially envelop the cleaning element, thereby shielding rotating components from exposure and providing a splash guard for cleaning fluid. The channel body 604 can be formed in or attached to sidewalls 620. The channel body 604 and the housing 600 can include channel 622 for receiving pipe 606.

Figure 25:
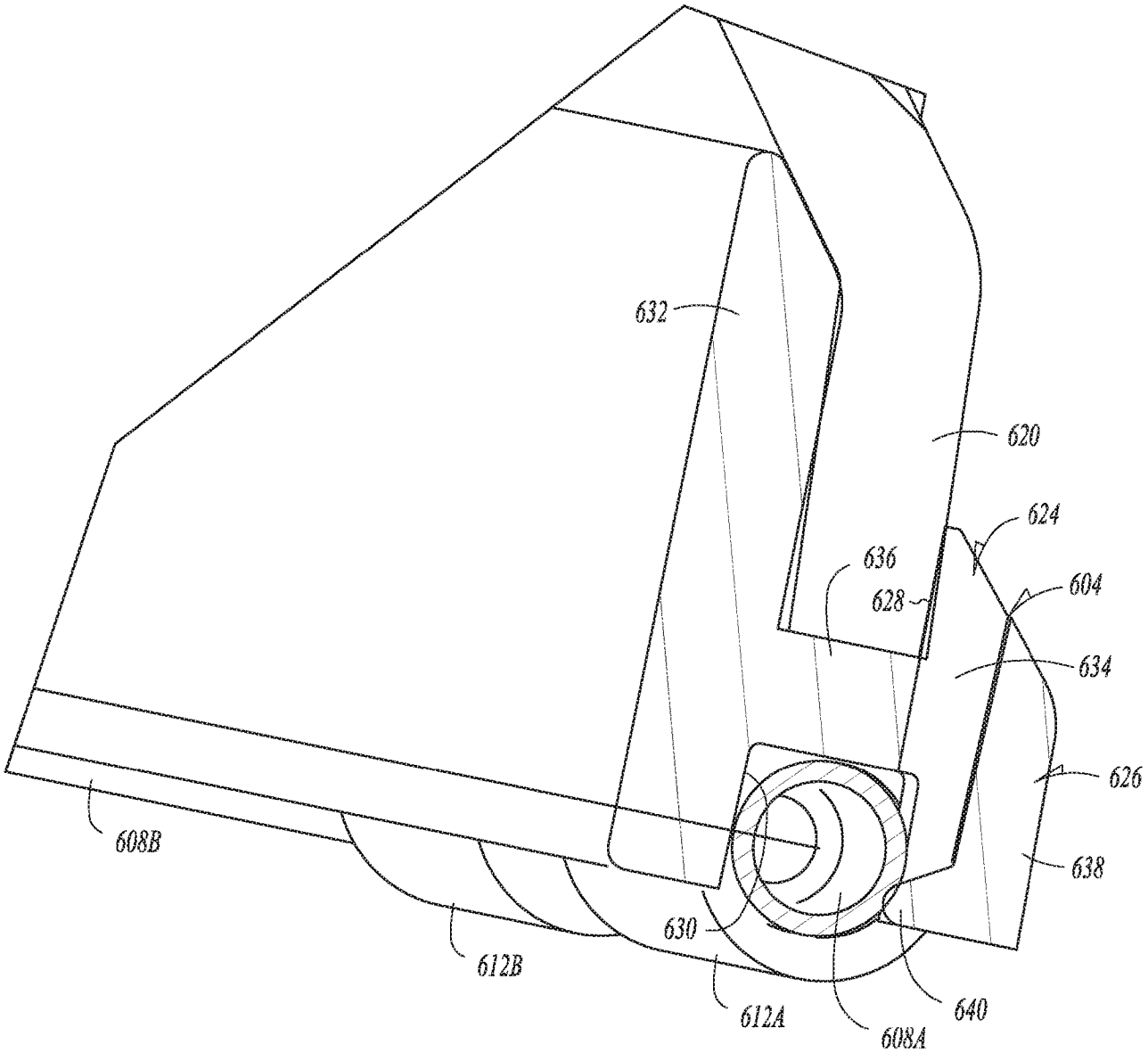
FIG. 25 is a close-up cross-sectional view of the housing and arcuate cleaning fluid manifold of FIG. 23 showing a hook for retaining the arcuate fluid manifold via a snap-fit.

FIG. 25 is a close-up cross-sectional view of the housing 600 and the arcuate cleaning fluid manifold 602 of FIG. 23 showing the channel body 604 including a coupling portion 624 and a hook portion 626 for retaining the arcuate fluid manifold 602 via a snap-fit. The coupling portion 624 can comprise an upper channel 628 for receiving the sidewall 620 and a lower channel 630 for receiving the manifold 602. The upper channel 628 and the lower channel 630 can be formed by an inner wall 632, an outer wall 634 and a cross piece 636. The hook portion 626 can comprise a mounting plate 638 and a hook 640.

Channel body 604 can be coupled to a wall of an existing cleaning head housing using suitable fasteners or coupling techniques, thereby simplifying manufacture or assembly of cleaning head assemblies. The manifold 602 can be positioned within the lower channel 630 and held in place with the hook 640 of hook portion 626. The mounting plate 638 of the hook portion 626 can be attached to the outer wall 634 of the coupling portion 624 using suitable fasteners or coupling techniques. For example, threaded fasteners can be used to secure the hook portion 626 to the outer wall 634. Thus, in order to remove the fluid manifold 602 from the housing 600, the threaded fasteners can be removed to permit the hook portion 626 to be removed from the coupling portion 624 to allow the fluid manifold 602 to be freely removed from the lower channel 630. In other embodiments, the hook 640 can be sized to permit the fluid manifold 602 to be snap fit into the lower channel 630. For example, the nominal width of the lower channel 630 can be slightly larger than the diameter of the fluid manifold 602, such as measured at first joint coupler 612A to permit the fluid manifold 602 freely rest in the lower channel 630. The width of the lower channel 630 at the hook 640 can be slightly less than the diameter of the first joint coupler 12A to allow the fluid manifold 602 to squeeze, e.g., by slightly compressing, into the lower channel 630. In various embodiments, the hook 640 can be crenelated or scalloped to, for example, accommodate differences in diameters of first joint coupler 12A, second joint coupler 12B, the first tube 608A and the second tube 608B, to reduce the weight of the channel body, and to change the snap fit engagement dynamic.

The features disclosed in the present application can provide future designers of floor scrubbers with a number of design options not previously available. With prior art rotary motion scrubbers such as that illustrated in FIG. 1, solution run time and recovery tank capacity, as opposed to battery run time, have been the primary limiting factors in scrubber design. Thus, the operator must make several solution tank refills and recovery tank disposals before the battery run time ends. However, the random orbit disc scrubber of the present application allows for a reduction in the number of solution tank refills and recovery tank disposals as compared with prior art rotary motion scrubbers. This is possible because combining rotary and orbital movement together in a single machine allows for slower rotary movement and less fluid dispersal as compared to prior art rotary motion scrubbers to achieve the same level and quality of cleaning. Furthermore, the various arcuate cleaning fluid manifolds, mounting locations for the manifolds and various dispensing orifices and nozzles described herein can further minimize cleaning fluid consumption by more strategically placing controlled amounts of cleaning fluid at locations where the cleaning fluid can be more efficiently utilized by the cleaning element.

VARIOUS NOTES & EXAMPLES

Example 1 can include or use subject matter such as a floor scrubber machine that can comprise a main body having a front end and a rear end, a cleaning fluid tank carried by the main body, a cleaning head assembly connected to the main body, the cleaning head assembly can comprise a cleaning element driver, a motor configured to impart rotational movement through a shaft to the cleaning element driver, and a cleaning element coupled to the cleaning element driver and structured for contact with a floor surface, and an arcuate cleaning fluid manifold fluidly coupled to the cleaning fluid tank, the arcuate cleaning fluid manifold mounted to the floor scrubber machine forward of the shaft.

Example 2 can include, or can optionally be combined with the subject matter of Example 1, to optionally include an arcuate cleaning fluid manifold that can include three or more discharge orifices.

Example 3 can include, or can optionally be combined with the subject matter of one or any combination of Examples 1 or 2 to optionally include three or more discharge orifices that can have spacing intervals in the range of 1.0 inch (~2.54 cm) to 7.0 inches (~17.78 cm) across a length of the arcuate cleaning fluid manifold.

Example 4 can include, or can optionally be combined with the subject matter of one or any combination of Examples 1 to 3 to optionally include three or more discharge orifices that can have a diameter in the range of 0.055 inch (~1.397 mm) to 0.075 inch (~1.905 mm).

Example 5 can include, or can optionally be combined with the subject matter of one or any combination of Examples 1 to 4 to optionally include three or more discharge orifices that can comprise elastomeric nozzles.

Example 6 can include, or can optionally be combined with the subject matter of one or any combination of Examples 1 to 5 to optionally include elastomeric nozzles that can comprise a body and a discharge opening in the body, wherein the discharge opening flexes in response to changes in the discharge rate.

Example 7 can include, or can optionally be combined with the subject matter of one or any combination of Examples 1 to 6 to optionally include an arcuate cleaning fluid manifold that can be mounted to the floor scrubber machine forward of the cleaning element.

Example 8 can include, or can optionally be combined with the subject matter of one or any combination of Examples 1 to 7 to optionally include three or more discharge orifices that can be angled toward the cleaning element.

Example 9 can include, or can optionally be combined with the subject matter of one or any combination of Examples 1 to 8 to optionally include an arcuate cleaning fluid manifold that can be mounted to the floor scrubber machine above the cleaning element.

Example 10 can include, or can optionally be combined with the subject matter of one or any combination of Examples 1 to 9 to optionally include an arcuate cleaning fluid manifold that can include two or more spaced apart feed lines fluidly coupled to the cleaning fluid tank.

Example 11 can include, or can optionally be combined with the subject matter of one or any combination of Examples 1 to 10 to optionally include an additional separate arcuate cleaning fluid manifold that can be spaced from the arcuate cleaning fluid manifold in either a forward direction or an aftward direction.

Example 12 can include, or can optionally be combined with the subject matter of one or any combination of Examples 1 to 11 to optionally include a cleaning head assembly that can further comprise an eccentric cam to impart orbital movement on the cleaning element.

Example 13 can include, or can optionally be combined with the subject matter of one or any combination of Examples 1 to 12 to optionally include a squeegee assembly that can be mounted to the floor scrubber machine so as to be positioned aft of the shaft.

Example 14 can include, or can optionally be combined with the subject matter of one or any combination of Examples 1 to 13 to optionally include a squeegee assembly and an arcuate cleaning fluid manifold that can be rotatably mounted to the floor scrubber machine about an approximate center of the shaft.

Example 15 can include, or can optionally be combined with the subject matter of one or any combination of Examples 1 to 14 to optionally include a carriage comprising a mount rotatably coupled to the cleaning head assembly about the shaft, a first extension extending from the mount and coupled to the squeegee assembly, and a second extension extending from the mount and coupled to the arcuate cleaning fluid manifold.

Example 16 can include, or can optionally be combined with the subject matter of one or any combination of Examples 1 to 15 to optionally include an arcuate cleaning fluid manifold that can extends along a width in the range of at least about forty percent of a width of the cleaning path of the cleaning element to about one-hundred percent of the width of the cleaning path of the cleaning element.

Example 17 can include or use subject matter such as a scrubber head assembly for a floor cleaning machine, the scrubber head assembly can comprise a mounting plate having an opening, a motor-driven shaft extending through the opening, a driver coupled to the motor-driven shaft, the driver configured to couple to a cleaning element for contacting a surface of a floor, and three or more cleaning fluid apertures disposed at different circumferential positions relative to the motor-driven shaft, the three or more cleaning fluid apertures configured to dispense cleaning fluid on, under or in front of the driver.

Example 18 can include, or can optionally be combined with the subject matter of Example 17, to optionally include an arcuate cleaning fluid manifold to which the three or more cleaning fluid apertures are connected.

Example 19 can include, or can optionally be combined with the subject matter of Examples 17 or 18, to optionally include a vertical peripheral wall extending from the mounting plate, wherein the arcuate cleaning fluid manifold is coupled to the vertical peripheral wall in front of the driver.

Example 20 can include, or can optionally be combined with the subject matter of Examples 17 to 19, to optionally include three or more cleaning fluid apertures that can be angled toward an underside of the driver.

Example 21 can include, or can optionally be combined with the subject matter of Examples 17 to 20, to optionally include an arcuate cleaning fluid manifold that can be coupled to the mounting plate and the driver includes a plurality of openings to permit cleaning fluid through the driver onto the cleaning element.

Example 22 can include, or can optionally be combined with the subject matter of Examples 17 to 21, to optionally include an additional separate cleaning fluid manifold fluidly coupled in parallel with the arcuate cleaning fluid manifold.

Example 23 can include, or can optionally be combined with the subject matter of Examples 17 to 22, to optionally include a valve to control flow to the arcuate cleaning fluid manifold and the additional separate cleaning fluid manifold.

Example 24 can include, or can optionally be combined with the subject matter of Examples 17 to 23, to optionally include an arcuate cleaning fluid manifold that can extend along a width in the range of at least about forty percent of a width of the cleaning path of the cleaning element to about one-hundred percent of the width of the cleaning path of the cleaning element.

Example 25 can include, or can optionally be combined with the subject matter of Examples 17 to 24, to optionally include three or more cleaning fluid apertures comprise flexible nozzles.

Example 26 can include, or can optionally be combined with the subject matter of Examples 17 to 25, to optionally include each of the three or more cleaning fluid apertures is configured to have a variable discharge opening.

Example 27 can include, or can optionally be combined with the subject matter of Examples 17 to 26, to optionally include a motor-driven shaft that can further comprise an eccentric cam to impart orbital movement on the driver.

Example 28 can include or use subject matter such as a random orbit scrubber that can comprise a main body having a front end and a rear end, a cleaning fluid tank carried by the main body, a cleaning head assembly connected to the main body, the cleaning head assembly can comprise a cleaning element driver, a cleaning element coupled to the cleaning element driver and structured for contact with a floor surface, and a motor operable to impart rotational and orbital movement on the cleaning element, and an arcuate cleaning fluid manifold fluidly coupled to the cleaning fluid tank, the cleaning fluid manifold mounted to the random orbit scrubber forward of the motor.

Example 29 can include, or can optionally be combined with the subject matter of Example 28, to optionally include an arcuate cleaning fluid manifold that can extend along at least about forty percent of a linear cleaning path width of the cleaning pad.

Example 30 can include, or can optionally be combined with the subject matter of Examples 28 or 29, to optionally include an arcuate cleaning fluid manifold that can include a plurality of discharge orifices with circumferential spacing intervals in the range of 1.0 inch (~2.54 cm) to 7.0 inches (~17.78 cm) across a length of the arcuate cleaning fluid manifold.

Example 31 can include, or can optionally be combined with the subject matter of Examples 28 to 30, to optionally include a cleaning head assembly that can further comprise a mounting plate to which the motor is coupled, and a peripheral wall extending below the mounting plate to at least partially cover the cleaning element, wherein the arcuate cleaning fluid manifold is mounted to the peripheral wall in front of the cleaning element.

Example 32 can include, or can optionally be combined with the subject matter of Examples 28 to 31, to optionally include an arcuate cleaning fluid manifold includes a plurality of discharge orifices that are angled backward toward the cleaning element.

Each of these non-limiting examples can stand on its own, or can be combined in various permutations or combinations with one or more of the other examples.

Although the present invention has been described with reference to preferred embodiments, workers skilled in the art will recognize that changes can be made in form and detail without departing from the scope of the invention.

The above detailed description includes references to the accompanying drawings, which form a part of the detailed description. The drawings show, by way of illustration, specific embodiments in which the invention can be practiced. These embodiments are also referred to herein as "examples" Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A mobile floor scrubber machine, comprising:

a main body having a front end and a rear end;

wheels connected to the main body to facilitate movement of the floor scrubber machine along a cleaning path;

an operator control connected to the main body to facilitate turning of the floor scrubber machine along the cleaning path;

a cleaning fluid tank carried by the main body;

a cleaning head assembly connected to the main body for driving a cleaning element, the cleaning head assembly comprising:

a cleaning element driver;

a motor configured to impart rotational movement through a shaft to the cleaning element driver;

a cleaning element housing in which the cleaning element driver is positioned, wherein the cleaning element housing is disposed a distance from the main body; and wherein the cleaning element is configured to be coupled to the cleaning element driver to provide cleaning of a floor surface over a surface area of the cleaning element when mounted to the cleaning element driver, the surface area defining an outer circumferential perimeter encompassing the surface area of the cleaning element; and a cleaning fluid manifold fluidly coupled to the cleaning fluid tank and mounted to an exterior surface of the cleaning element housing so as to be accessible from an exterior of the mobile floor scrubber machine, the cleaning fluid manifold extending along a curved sidewall on the exterior of the cleaning element housing so as to conform to curvature of the curved sidewall, the cleaning fluid manifold comprising a plurality of discharge orifices, wherein at least three or more of the plurality of discharge orifices are arranged along an arcuate path exterior to the outer circumferential perimeter of the cleaning element and forward of the shaft.

2. The mobile floor scrubber machine of claim 1, wherein the three or more discharge orifices have spacing intervals in the range of 1.0 inch (2.5 cm) to 7.0 inches (17.8 cm) across a length of the cleaning fluid manifold.

3. The mobile floor scrubber machine of claim 2, wherein the three or more discharge orifices have a diameter in the range of 0.055 inch (1.4 mm) to 0.075 inch (1.9 mm).

4. The mobile floor scrubber machine of claim 1, wherein the three or more discharge orifices comprise elastomeric nozzles.

5. The mobile floor scrubber machine of claim 4, wherein each of the elastomeric nozzles comprises:

a body; and a discharge opening in the body, wherein the discharge opening flexes in response to changes in the discharge rate.

6. The mobile floor scrubber machine of claim 1, wherein the at least three or more discharge orifices of the plurality of discharge orifices of the cleaning fluid manifold are positioned at a forward-most portion of the cleaning element housing.

7. The mobile floor scrubber machine of claim 6, wherein the three or more discharge orifices are angled toward the cleaning element.

8. The floor scrubber machine of claim 6, wherein the at least three or more discharge orifices of the plurality of discharge orifices of the cleaning fluid manifold are outside of the cleaning element housing.

9. The floor scrubber machine of claim 8, wherein the cleaning fluid manifold is positioned above a bottom surface of the cleaning element and below a top surface of a cleaning element housing.

10. The mobile floor scrubber machine of claim 1, wherein the cleaning fluid manifold is mounted to the floor scrubber machine above the cleaning element.

11. The mobile floor scrubber machine of claim 1, wherein the cleaning fluid manifold includes two or more spaced apart feed lines fluidly coupled to the cleaning fluid tank.

12. The mobile floor scrubber machine of claim 1, further comprising an additional separate cleaning fluid manifold spaced from the cleaning fluid manifold in either a forward direction or an aftward direction.

13. The mobile floor scrubber machine of claim 12, wherein a squeegee assembly and the additional separate cleaning fluid manifold are rotatably mounted to the floor scrubber machine about an approximate center of the shaft.

14. The mobile floor scrubber machine of claim 13, further comprising a carriage comprising:

a mount rotatably coupled to the cleaning head assembly about the shaft;

a first extension extending from the mount and coupled to the squeegee assembly; and a second extension extending from the mount and coupled to the additional separate cleaning fluid manifold.

15. The floor scrubber machine of claim 12, further comprising a valve to control flow to the cleaning fluid manifold and the additional separate cleaning fluid manifold.

16. The mobile floor scrubber machine of claim 1, wherein the cleaning head assembly further comprises an eccentric cam to impart orbital movement on the cleaning element.

17. The mobile floor scrubber machine of claim 1, further comprising a squeegee assembly mounted to the floor scrubber machine so as to be positioned aft of the shaft.

18. The mobile floor scrubber machine of claim 1, wherein the at least three or more discharge orifices of the plurality of discharge orifices of the cleaning fluid manifold are positioned to extend along a width in the range of at least about forty percent of a width of the cleaning path of the cleaning element to about one-hundred percent of the width of the cleaning path of the cleaning element.

19. The floor scrubber machine of claim 1, further comprising a recovery system configured to recover cleaning fluid released by the cleaning fluid manifold.

20. The floor scrubber machine of claim 19, wherein the recovery system comprises:

a squeegee assembly;

a vacuum recovery system; and a recovery tank.

21. The floor scrubber machine of claim 1, wherein the cleaning fluid manifold is outside the outer circumferential perimeter of the cleaning element.

22. The floor scrubber machine of claim 21, wherein the surface area of the cleaning element is circular.

23. The floor scrubber machine of claim 1, wherein the cleaning fluid manifold comprises a manifold housing extending along the arcuate path.

24. A scrubber head assembly for a floor cleaning machine, the scrubber head assembly comprising:

a mounting plate having an opening;

a motor-driven shaft extending through the opening;

a driver coupled to the motor-driven shaft, the driver configured to couple to a cleaning element for contacting a surface of a floor;

a cleaning element housing having a curved sidewall disposed in front of the driver;

a cleaning fluid manifold fastened to an exterior of the cleaning element housing of the scrubber head assembly so as to conform to curvature of the curved sidewall, the cleaning fluid manifold extending along the curved sidewall on the exterior of the cleaning element housing, and three or more cleaning fluid apertures in the cleaning fluid manifold and disposed at different circumferential positions relative to the motor-driven shaft so as to be disposed about an arcuate path, the three or more cleaning fluid apertures configured to dispense cleaning fluid in front of the driver.

25. The scrubber head assembly of claim 24, further comprising an additional separate cleaning fluid manifold fluidly coupled in parallel with the cleaning fluid manifold.

26. The scrubber head assembly of claim 24, wherein the three or more cleaning fluid apertures of the cleaning fluid manifold are positioned to extend along a width in the range of at least about forty percent of a width of a cleaning path of the cleaning element to about one-hundred percent of the width of the cleaning path of the cleaning element.

27. The scrubber head assembly of claim 24, wherein the motor-driven shaft further comprises an eccentric cam to impart orbital movement on the driver.

28. The scrubber head assembly of claim 24, wherein the cleaning fluid manifold is fastened to a forward-most portion of an exterior of a cleaning element housing that covers the mounting plate of the scrubber head assembly.

29. A random orbit scrubber comprising:

a main body having a front end and a rear end;

a cleaning fluid tank carried by the main body;

a cleaning head assembly connected to the main body, the cleaning head assembly comprising:

a cleaning element driver for a cleaning element;

a cleaning element housing covering the cleaning element driver and configured to cover the cleaning element when the cleaning element is mounted to the cleaning element driver; and a motor operable to impart rotational and orbital movement on the cleaning element;

an arcuate cleaning fluid manifold fluidly coupled to the cleaning fluid tank and mounted so as to extend along an arcuate sidewall of the cleaning element housing on an exterior of the cleaning head assembly, the cleaning fluid manifold mounted to the random orbit scrubber at a forward most portion of the random orbit scrubber, and a plurality of discharge orifices in the arcuate cleaning fluid manifold.

30. The random orbit scrubber of claim 29, wherein:

the arcuate cleaning fluid manifold includes a plurality of discharge orifices that are positioned to extend along at least about forty percent of a width of the cleaning element driver; and the plurality of discharge orifices have circumferential spacing intervals in the range of 1.0 inch (~2.54 cm) to 7.0 inches (~17.78 cm) across a length of the arcuate cleaning fluid manifold.

31. The random orbit scrubber of claim 29, wherein the arcuate cleaning fluid manifold is suspended forward of the cleaning element housing.

32. The random orbit scrubber of claim 29, further comprising an additional separate cleaning fluid manifold rotatably mounted to the cleaning head assembly.

* * * * *